US007076433B2

(12) United States Patent
Ito et al.

(10) Patent No.: US 7,076,433 B2
(45) Date of Patent: Jul. 11, 2006

(54) APPARATUS AND PROGRAM FOR SEPARATING A DESIRED SOUND FROM A MIXED INPUT SOUND

(75) Inventors: Masashi Ito, Wako (JP); Hiroshi Tsujino, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 653 days.

(21) Appl. No.: 10/052,309

(22) Filed: Jan. 17, 2002

(65) Prior Publication Data

US 2002/0133333 A1 Sep. 19, 2002

(30) Foreign Application Priority Data

Jan. 24, 2001 (JP) ..... 2001-016055
Nov. 5, 2001 (JP) ..... 2001-339622

(51) Int. Cl.
*G10L 19/02* (2006.01)

(52) U.S. Cl. ..... 704/500; 704/501

(58) Field of Classification Search ..... 704/261, 704/200.1, 500, 501; 702/66
See application file for complete search history.

(56) References Cited

U.S. PATENT DOCUMENTS 4,885,790 A 12/1989 McAulay et al.

FOREIGN PATENT DOCUMENTS

JP 05-036081 2/1993
JP 07-167271 7/1995

(Continued)

OTHER PUBLICATIONS

Klapuri et al., "Robust Multipitch Estimation for the Analysis and Manipulation of Polyphonic Musical Signals,"Proc. of COST-G6 Conference on Digital Audio Effects, Dec. 7-9, 2000.*

(Continued)

*Primary Examiner*—V. Paul Harper
(74) *Attorney, Agent, or Firm*—Fenwick & West LLP

(57) ABSTRACT

A sound separation apparatus for separating a target signal from a mixed input signal, wherein the mixed input signal includes the target signal and one or more sound signals emitted from different sound sources. The sound separation apparatus according comprises a frequency analyzer for performing a frequency analysis on the mixed input signal and calculating spectrum and frequency component candidate points at each time. The apparatus further comprises feature extraction means for extracting feature parameters which are estimated to correspond with the target signal, comprising a local layer for analyzing local feature parameters using the spectrum and the frequency component candidate points and one or more global layers for analyzing global feature parameters using the feature parameters extracted by the local layer. The apparatus further comprises a signal regenerator for regenerating a waveform of the target signal using the feature parameters extracted by the feature extraction means.

Since both of local feature parameters and global feature parameters can be processed together in the feature extraction means, the separation accuracy of the target signal is improved without depending on the accuracy for extracting feature parameters from the input signal. Feature parameters to be extracted include frequencies and amplitudes and their variation rates for the frequency component candidate points, harmonic structure, pitch consistency, intonation, on-set/off-set information and/or sound source direction. The number of the layers provided in the feature extraction means may be changed according to the types of the feature parameters to be extracted.

30 Claims, 22 Drawing Sheets

FOREIGN PATENT DOCUMENTS

JP 08-068560 3/1996

OTHER PUBLICATIONS

Tolonen "Methods for Separation of Harmonic Sound Sources using Sinusoidal Modeling," in AES 106th Convention, Munich Germany, May 1999.*

Tuomas Virtanen, et al. "Separation of Harmonic Sound Sources Using Sinusoidal Modeling", *Proceedings 2000 IEEE International Conference on Acoustics, Speech and Signal Processing*, vol. 2, Jun. 2000, pp. 765-768.

Tomohiro Nakatani et al., "Harmonic Sound Stream Segregation Using Localization and its Application to Speech Stream Segregation", *Speech Communication, Elsevier Science B.V.*, vol. 27, No. 3-4, Apr. 1999, pp. 209-222.

Motosugu Abe et al., "Auditory Scene Analysis Based on Time-Frequency Integration of Shared FM and AM", *Acoustics, Speech and Signal Processing, Proc. 1998 IEEE International Conference, Seattle, Washington*, May 1998, pp. 2421-2424.

Robert J. McAulay, "Speech Analysis/Synthesis Based on a Sinusoidal Representation", *IEEE Transactions on Acoustics, Speech and Signal Processing*, vol. ASSP-34, No. 4, Aug. 1986, pp. 744-754.

* cited by examiner

| | cf[kHz] | df[kHz/ms] | ca[dB] | da [dB/ms] |
|---|---|---|---|---|
| s1 | 0.5 | -0.01 | -10 | 0.0 |
| s2 | 1.0 | 0.02 | 0 | -1.0 |
| s3 | 1.2 | 0.00 | -15 | 2.0 |

FIG. 5 df da cf ca

Spectrum of Target Signal

Spectrum of mixed Input Signal

Spectrum of Output Signal

Elimination of Intermittent Noises

Spectrum of Target Signal

Spectrum of mixed Input Signal

Spectrum of Output Signal

Elimination of White Noises

Spectrum of Target Signal

Spectrum of mixed Input Signal

Spectrum of Output Signal

Elimination of Another Speech

APPARATUS AND PROGRAM FOR SEPARATING A DESIRED SOUND FROM A MIXED INPUT SOUND

TECHNICAL FIELD

The invention relates to apparatus and program for extracting features precisely from a mixed input signal in which one or more sound signals and noises are intermixed. The invention also relates to apparatus and program for separating a desired sound signal from the mixed input signal using the features.

BACKGROUND OF THE INVENTION

Exemplary well-known techniques for separating a desired sound signal (hereinafter referred to as "target signal") from a mixed input signal containing one or more sound signals and noises include spectrum subtraction method and method with comb filters. In the former, however, only steady noises can be separated from the mixed signal. In the latter, the method is only applicable to target signal in steady state of which fundamental frequency does not change. So these methods are hard to be applied to real applications.

Other known method for separating target signals is as follows: first a mixed input signal is multiplied by a window function and is applied with discrete Fourier transform to get spectrum. And local peaks are extracted from the spectrum and plotted on a frequency to time (f-t) map. On the assumption that those local peaks are candidate points which are to compose the frequency component of the target signal (hereinafter referred to as "frequency component candidate point"), those local peaks are connected toward the time direction to regenerate frequency spectrum of the target signal. More specifically, a local peak at a certain time is first compared with another local peak at next time on the f-t map. Then these two points are connected if the continuity is observed between the two local peaks in terms of frequency, power and/or sound source direction to regenerate the target signal.

According to the methods, it is difficult to determine the continuity of the two local peaks in the time direction. In particular, when the signal to noise (S/N) ratio is high, the local peaks of the target signal and the local peaks of the noise or other signal would be located very closely. So the problem gets worse because there are many possible connections between the candidate local peaks under such condition.

Furthermore, amplitude spectrum extends in a hill-like shape (leakage) because of the influences by integral within a finite time range and time variation of the frequency and/or amplitude. In conventional signal analysis, frequencies and amplitudes of local peaks in the amplitude spectrum are determined as frequencies and amplitudes of the target signal in the mixed input signal. So accurate frequencies and amplitudes could not be obtained in the method. And, if the mixed input signal includes several signals and the center frequencies of them are located adjacently each other, only one local peak may appear in the amplitude spectrum. So it is impossible to estimate amplitude and frequency of the signals accurately.

Signals in the real world are generally not steady but a characteristic of quasi-steady periodicity are frequently observed (the characteristic of quasi-steady periodicity means that the periodic characteristic is continuously variable (such signal will be referred to as "quasi-steady signal" hereinafter)). While the Fourier transform is very useful for analyzing periodic steady signals, various problems would be emerged if the discrete Fourier transform is applied to the analysis for such quasi-steady signals.

Therefore, there is a need for a sound separating method and apparatus that is capable of separating a target signal form a mixed input signal containing one or more sound signals and/or unsteady noises.

SUMMARY OF THE INVENTION

To solve the problems noted above, instantaneous encoding apparatus and program according to the invention is provided for accurately extracting frequency component candidate points even though frequency and/or amplitude for a target signal and noises contained in a mixed input signal change dynamically (in quasi-steady state). Furthermore, a sound separation apparatus and program according to the invention is provided for accurately separating a target signal from a mixed input signal even though the frequency component candidate points for the target signal and noises are located closely each other.

An instantaneous encoding apparatus is disclosed for analyzing an input signal using the data obtained through a frequency analysis on instantaneous signals which are extracted from the input signal by multiplying the input signal by a window function. The apparatus comprises unit signal generator for generating one or more unit signals, wherein each unit signal have such energy that exists only at a certain frequency wherein the frequency and the amplitude of each of the unit signals are continuously variable with time. The apparatus further comprises an error calculator for calculating an error between the spectrum of the input signal and the spectrum of the one unit signal or the spectrum of the sum of the plurality of unit signals in the amplitude/phase space. The apparatus further comprises altering means for altering the one unit signal or the plurality of unit signals to minimizing the error and outputting means for outputting the one unit signal or the plurality of unit signals after altering as a result of the analysis for the input signal.

The generator generates the unit signals corresponding to the number of local peaks of the amplitude spectrum for the input signal. Thus, the spectrum of the input signal containing a plurality of quasi-steady signals may be analyzed accurately and the time required for the calculations may be reduced.

Each of the one or more unit signals has as its parameters the center frequency, the time variation rate of the center frequency, the amplitude of the center frequency and the time variation rate of the amplitude. Thus, from a single spectrum, time variation rates may be calculated for the quasi-steady signal wherein the frequency and/or the amplitude are variable in time.

A sound separation apparatus is also disclosed for separating a target signal from a mixed input signal in which the target signal and other sound signals emitted from different sound sources are intermixed. The sound separation apparatus according to the invention comprises a frequency analyzer for performing a frequency analysis on the mixed input signal and calculating spectrum and frequency component candidate points at each time. The apparatus further comprises feature extraction means for extracting feature parameters which are estimated to correspond with the target signal, comprising a local layer for analyzing local feature parameters using the spectrum and the frequency component candidate points and one or more global layers for analyzing global feature parameters using the feature parameters extracted by the local layer. The apparatus further comprises a signal regenerator for regenerating a waveform of the target signal using the feature parameters extracted by the feature extraction means.

Since both of local feature parameters and global feature parameters can be processed together in the feature extraction means, the separation accuracy of the target signal is improved without depending on the accuracy for extracting feature parameters from the input signal. Feature parameters to be extracted include frequencies, amplitudes and their time variation rates for the frequency component candidate points, harmonic structure, pitch consistency, intonation, on-set/off-set information and/or sound source direction. The number of the layers provided in the feature extraction means may be changed according to the types of the feature parameters to be extracted.

The local and global layers may be arranged to mutually supply the feature parameters analyzed in each layer to update the feature parameters in each layer based on the supplied feature parameters. Thus, consistency among the feature parameters are enhanced and accordingly the accuracy of extracting the feature parameters from the input signal is improved because the feature parameters analyzed in each layer of the feature extraction means are exchanged mutually among the layers.

The local layer may be an instantaneous encoding layer for calculating frequencies, time variations of said frequencies, amplitudes, and time variations of said amplitudes for said frequency component candidate points. Thus, the apparatus may follow moderate variations of frequencies and amplitudes of the signals from same sound source by utilizing the instantaneous time variation information.

The global layer may comprises a harmonic calculation layer for grouping the frequency component candidate points having same harmonic structure based on said calculated frequencies and variations of frequencies and then calculating a fundamental frequency of said harmonic structure, time variations of said fundamental frequency, harmonics contained in said harmonic structure, and time variations of said harmonics. The global layer may further comprise a pitch continuity calculation layer for calculating a continuity of signal using said fundamental frequency and said time variation of the fundamental frequency at each point in time.

One exemplary change to be calculated is preferably the time variation rate. However, any other function such as derivative of second order may be used as long as it can acquire the change of the frequency component candidate points. The target signal intermixed with non-periodic noises may be separated by using its consistency even though frequencies and amplitudes of the target signals gradually change.

All of the layers in the feature extraction means may be logically composed of one or more computing elements capable of performing similar processes to calculate feature parameters. Each computing elements mutually exchanges the calculated feature parameters with other elements included in upper and lower adjacent layers of one layer.

The computing element herein is not intended to indicate any physical element but to indicate an information processing element that is prepared with one by one corresponding to the feature parameters and is capable of performing the same process individually and of supplying the feature parameters mutually with other computing elements.

The computing element may execute steps of following: calculating a first consistency function indicating a degree of consistency between the feature parameters supplied from the computing element included in the upper adjacent layer and said calculated feature parameters; calculating a second consistency function indicating a degree of consistency between the feature parameters supplied from the computing element included in the lower adjacent layer and said calculated feature parameters; updating said feature parameters to maximize a validity indicator that is represented by a product of said first consistency function and said second consistency function. Thus, high consistency may be attained gradually through the mutual references to the feature parameters among the computing elements.

The validity indicator is supplied to computing elements included in the lower adjacent layer. Thus, the convergence time is reduced by increasing the dependency of the computing elements on the upper layer or to decrease the influence from the upper layer by weakening such dependency. And it is possible to perform such control that many feature parameters are retained while the number of the calculations is relatively small but the survival condition may be set more and more rigid as the consistency among each layer becomes stronger. It is possible to calculate a new threshold value whenever the validity indicator in the upper layer is updated and to make the computing element disappear when the validity indicator value becomes below the threshold value, to quickly remove unnecessary feature parameters. Furthermore, it is possible to perform flexible data updates including generation of new computing elements in the one level lower layer when the validity indicator is more than a given value.

Other features and embodiments of the invention will be apparent for those skilled in the art when reading the following detailed description with reference to the attached drawings.

BRIEF DESCRIPTION OF THE DRAWINGS

FIG. 5 is a table showing an example of input signal containing a plurality of quasi-steady signals;

DETAILED DESCRIPTION OF THE PREFERRED EMBODIMENTS

1. Instantaneous Encoding

First an instantaneous encoding apparatus according to the invention is described in detail.

1.1 Principle of Instantaneous Encoding

The inventors analyze the leakage of the spectrum in the amplitude/phase space when a frequency translation is performed on frequency modulation (FM) signal and Amplitude Modulation (AM) signal.

FM signal is defined as a signal that the instantaneous frequency of the wave continuously varies over time. FM signal also includes signals of which instantaneous frequency varies non-periodically. For FM voice signals, the signal would be perceived as a pitch-varying sound.

AM signal is defined as a signal that the instantaneous amplitude of the wave continuously varies over time. AM signal also includes signals of which instantaneous amplitude varies non-steadily. For AM voice signals, the signal would be perceived as a magnitude-varying sound.

A quasi-steady signal has characteristics of both FM and AM signals as mentioned above. Thus, provided that f(t) denotes a variation pattern of the instantaneous frequency and a(t) denotes a variation pattern of the instantaneous amplitude, the quasi-steady signal can be represented by the following equation (1).

$$s(t)=a(t)\cos(2\pi\int f(t)dt) \quad (1)$$

Figure 2A:
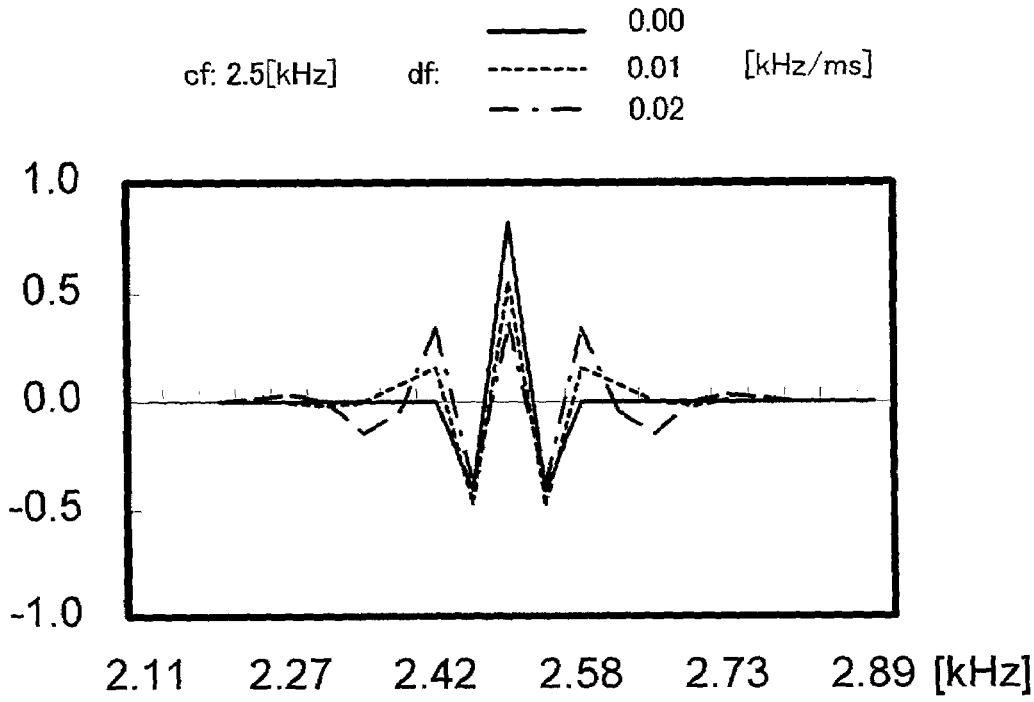
FIG. 2A illustrates the real part of the spectra gained by discrete Fourier transform performed on exemplary FM signals.
Figure 2B:
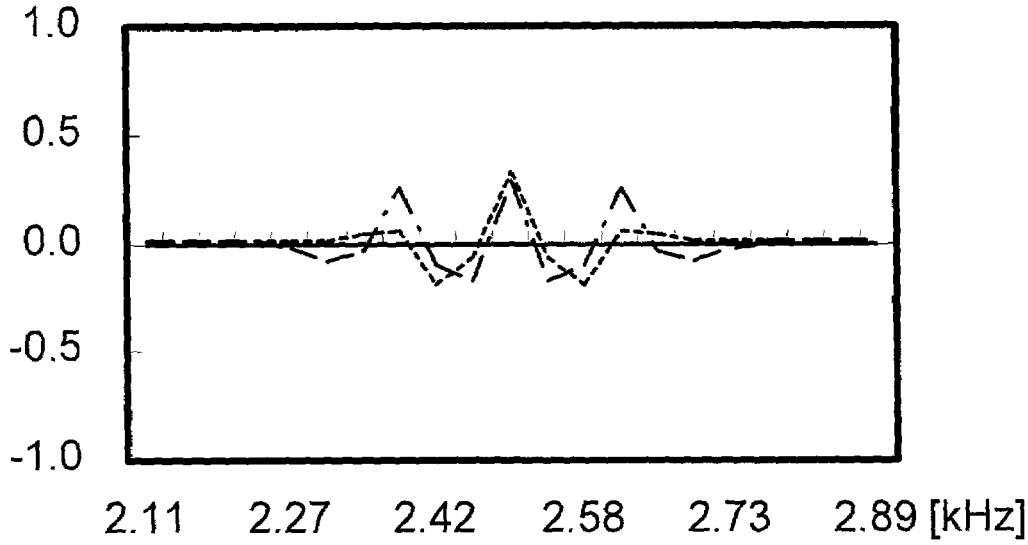
FIG. 2B illustrates the imaginary part of the spectra gained by discrete Fourier transform performed on exemplary FM signals.

After a frequency analysis is performed on the FM signal and/or AM signal, observing the real part and the imaginary part consisting the resulting spectrum clarifies the difference in terms of the time variation rate. FIGS. 2A–2B illustrates the spectra of the exemplary FM signals obtained by the discrete Fourier transform. Center frequency (cf) of the FM signals are all 2.5 KHz but their frequency time variation rates (df) are 0, 0.01, 0.02 kHz/ms respectively. FIG. 2A shows the real part of the spectra and FIG. 2B shows the imaginary parts of the spectra. It will be clear that the patterns of the spectra of the three FM signals are different each other according to the magnitude of their frequency time variation rates.

Figure 3A:
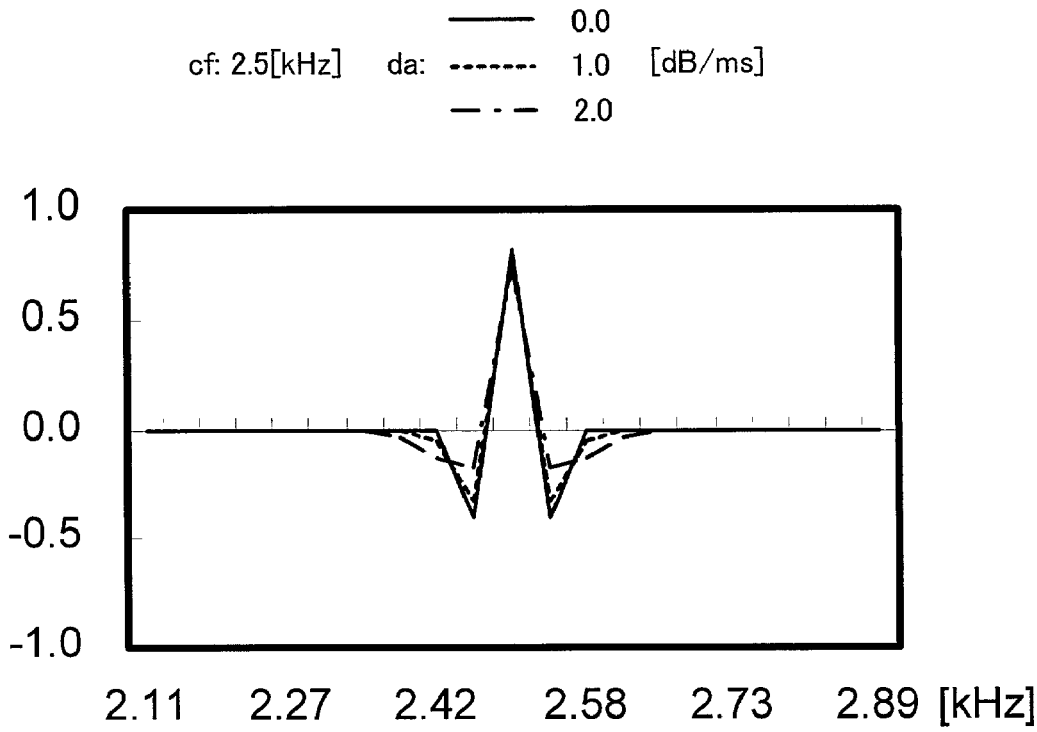
FIG. 3A illustrates the real part of the spectra gained by discrete Fourier transform performed on exemplary AM signals.
Figure 3B:
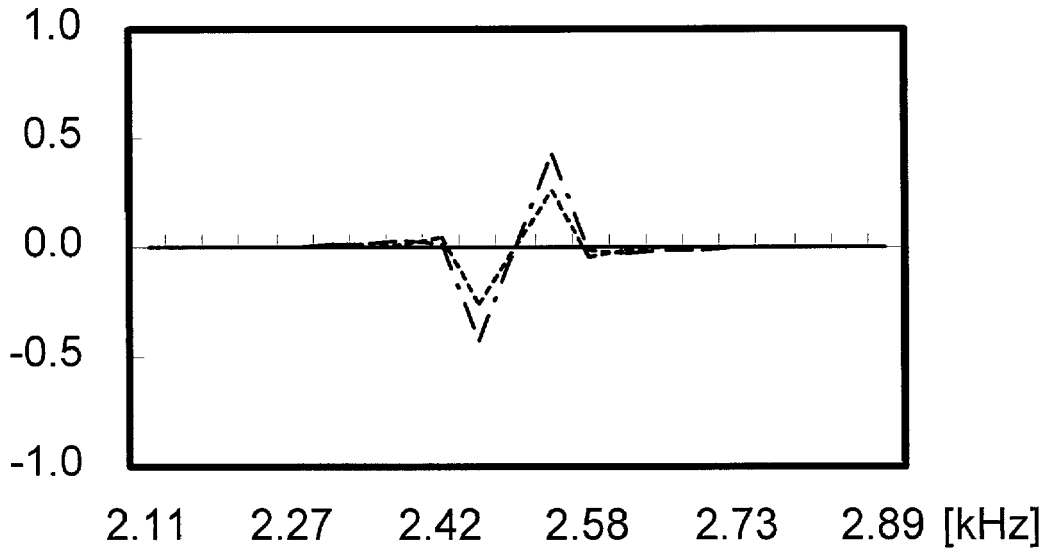
FIG. 3B illustrates the imaginary part of the spectra gained by discrete Fourier transform performed on exemplary 1 AM signals.

FIGS. 3A–3B illustrates the spectra of the exemplary AM signals obtained by the discrete Fourier transform. Center frequency (cf) of the AM signals are all 2.5 KHz but their amplitude time variation rates (df) are 0, 1.0, 2.0 dB/ms respectively. FIG. 3A shows the real part of the spectra and FIG. 3B shows the imaginary parts of the spectra. As in the case of FM signals, it will be clear that the patterns of the spectra of the three AM signals are different each other according to the magnitude of their amplitude frequency time variation rates (da). Such differences could not be clarified by general frequency analysis based on the conventional amplitude spectrum in which the frequency is defined in the horizontal axis and the amplitude is defined in the vertical axis. In contrast, the magnitude of the variation rate may be uniquely determined from the pattern of the spectrum in one aspect of the invention because it is employed the method using the real and imaginary parts obtained by the discrete Fourier transform noted above. Additionally, time variation rates for the frequency and the amplitude may be obtained from a single spectrum rather than a plurality of time-shifted spectra.

1.2 Structure of Instantaneous Encoding

Figure 1:
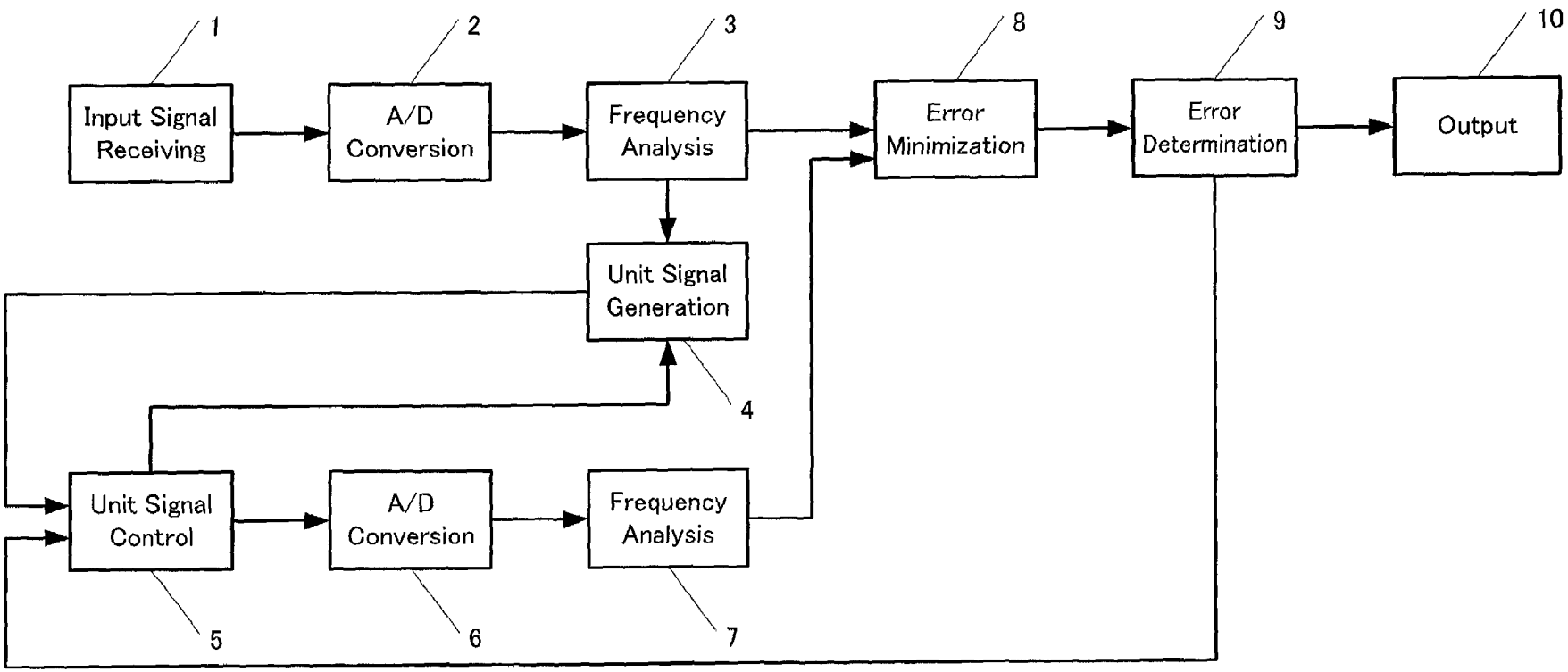
FIG. 1 is a block diagram for illustrating an instantaneous encoding apparatus and program according to the invention.

FIG. 1 is a block diagram illustrating an instantaneous encoding apparatus according to one embodiment of the invention. A mixed input signal is received by an input signal receiving block 1 and supplied to an analog-to-digital (A/D) conversion block 2, which converts the input signal to the digitized input signal and supplies it to a frequency analyzing block 3. The frequency analyzing block 3 first multiplies the digitized input signal by a window function to extract the signal at a given instant. The frequency-analyzing block 3 then performs a discrete Fourier transform to calculate the spectrum of the mixed input signal. The calculation result is stored in a memory (not shown). The frequency-analyzing block 3 further calculates the power spectrum of the input signal, which will be supplied to a unit signal generation block 4.

The unit signal generation block 4 generates a required number of unit signals responsive to the number of local peaks of the power spectrum of the input signal. A unit signal is defined as a signal that has the energy localizing at its center frequency and has, as its parameters, a center frequency and a time variation rate for the center frequency as well as an amplitude of the center frequency and a time variation rate for that amplitude. Each unit signal is received by a unit signal control block 5 and supplied to an A/D conversion block 6, which converts the unit signal to a digitized signal and supplies it to a frequency-analyzing block 7. The frequency-analyzing block 7 calculates a spectrum for each unit signal and adds the spectra of all unit signals to get a sum value.

The spectrum of the input signal and the spectrum of the sum of unit signals are sent to an error minimization block 8, which calculates a squared error of both spectra in the amplitude/phase space. The squared error is sent to an error determination block 9 to determine whether the error is a minimum or not. If it is determined to be a minimum, the process proceeds to an output block 10. If it is determined to be not a minimum, such indication is sent to the unit signal control block 5, which then instructs the unit signal generation block 4 to alter parameters of each unit signal for minimizing the received error or to generate new unit signals if necessary. After the aforementioned process are repeated, the output block 10 receives the sum of the unit signals from the error determination block 9 and output it as signal components contained in the mixed input signal.

1.3 Process of Instantaneous Encoding

Figure 4:
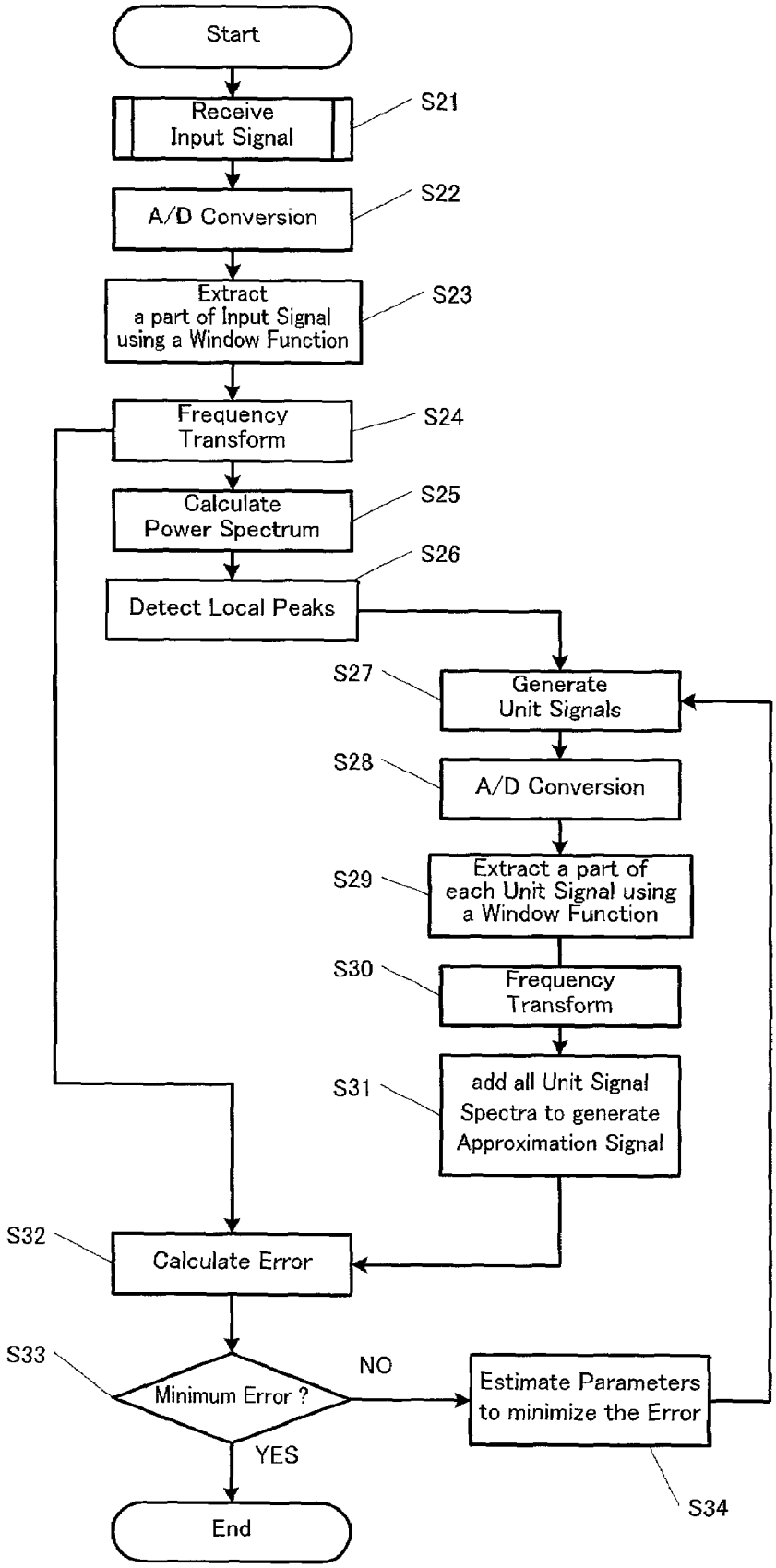
FIG. 4 shows a flow chart for process of the instantaneous encoding apparatus.

FIG. 4 shows a flow chart of the instantaneous encoding process according to the invention. A mixed input signal s(t) is received (S21). The mixed input signal is filtered by such as low-pass filter and converted to the digitized signal S(n) (S22). The digitized signal is multiplied by a window function W(n) such as a Hunning window or the like to extract a part of the input signal. Thus, a series of data W(n)·S(n) are obtained (S23).

A frequency transform is performed on the obtained series of input signals to obtain the spectrum of the input signal. Fourier transform is used for frequency transform in this embodiment, but any other method such as a wavelet transform may be used. On the series of data W(n)·S(n) discrete Fourier transform is performed and spectrum s(f), which is complex number data, is obtained (S24). $S_x(f)$ denotes the real part of s(f) and $S_y(f)$ denotes the imaginary part. $S_x(f)$ and $S_y(f)$ are stored in the memory for later use in an error calculation step.

A power spectrum $p(f)=\{S_x(f)\}^2+\{S_y(f)\}^2$ is calculated for the mixed input signal spectrum (S25). The power spectrum typically contains several peaks (hereinafter referred to as "local peaks") as shown in a curve in FIG. 6, in which the amplitude is represented by a dB value relative to a given reference value.

It should be noted that the term "local peak" is different from the term "frequency component candidate points" herein. Local peaks mean only the peaks of power spectrum. Therefore local peaks may not represent the "true" frequency component of the input signal accurately because of the leakage or the like as described before. On the other hand, frequency component candidate points refer to the "true" frequency component of the input signal. As described later with regard to sound separation apparatus, since the input signal includes target signal and noises, frequency components will arise from both the target signal and noises. So the frequency components should be sorted to regenerate the target signal, which is the reason that they are called "candidate".

Back to FIG. 4, the number of the local peaks in the power spectrum is detected, and then the frequency of each local peak and the amplitude of the frequency component of each local peak are obtained (S26). For purpose of illustration, it is assumed that k local peaks, each of which has frequency $cf_i$ and amplitude $ca_i$ (i=1, 2, . . . , k), have been detected.

It should be noted that the calculation of the power spectrum is not necessarily required or alternatively a cepstrum analysis or the like may be used because the power spectrum is used only for generating unit signals as many as the number of local peaks of power spectrum. Steps S25 and S26 are performed for establishing in advance the number of the unit signals u(t) to be generated to reduce the calculation time, these steps S25 and S26 are optional.

Now how unit signals are generated is explained. First, k unit signals $u(t)_i$ (i=1, 2, . . . , k) are generated as many as the number of local peaks detected in S26 (S27). A unit signal is a function having, as its center frequency, a frequency $cf_i$ obtained in step S26 and also having, as its parameters, frequency and/or amplitude time variation rates. An example of unit signal may be represented as the following function (2).

$$u(t)_i=a(t)_i \cos(2\pi\int f(t)_i dt) \quad (i=1,2, \ldots, k) \tag{2}$$

where $a(t)_i$ represent a time variation function for the instantaneous amplitude and $f(t)_i$ a time variation function for the instantaneous frequency. Using the functions to represent the amplitude and the frequency for the frequency component candidate points is one feature of the invention and thereby the variation rates for the quasi-steady signals may be obtained as described later.

Instantaneous amplitude time variation function $a(t)_i$ and instantaneous frequency time variation function $f(t)_i$ may be represented as follows by way of example.

$$a(t)_i = ca_i \cdot 10^{\frac{da_i t}{20}} \tag{3}$$

$$f(t)_i=cf_i+df_i \cdot t \tag{4}$$

where $ca_i$ denotes an coefficient for the amplitude, $da_i$ denotes a time variation coefficient for the amplitude, $cf_i$ denotes a center frequency for the local peak and $df_i$ denotes a time variation coefficient for the frequency component candidate point center frequency. Although $a(t)_i$ and $f(t)_i$ are represented in the above-described form for convenience in calculation, any other function may be used as long as it could represent the quasi-steady state. As initial values for each time variation coefficient, predefined value is used for each unit signal or appropriate values are input by user.

Each unit signal can be regarded as an approximate function for each frequency component candidate point of the power spectrum of the corresponding input signal.

In a like manner for processing the input signal, each unit signal is converted to the digitized signal (S28). Then, the digitalized signal is multiplied by a window function to extract a part of the unit signal (S29). A spectrum $U(f)_i$ (i=1,2 . . . , k), the complex number data, can be gained by the discrete Fourier transform (S30). $U_x(f)_i$ and $U_y(f)_i$ 1 denotes a real part and an imaginary part of $U(f)_i$ respectively.

If the mixed input signal includes a plurality of quasi-steady signals, it is regarded that each local peak of the power spectrum of the input signal were generated due to the corresponding quasi-steady signal. Therefore, in this case, the input signal could be approximated by a combination of the plurality of unit signals. If two or more unit signals are generated, each real part $U_x(f)_i$ and each imaginary part $U_y(f)_i$ of $U(f)_i$ are summed up to generate an approximate signal A(f). $A_x(f)$ and $A_y(f)$ denotes a real part and an imaginary part of A(f) respectively.

Because the input signal may include a plurality of signals having the respective phases which are different each other, each unit signal is added after rotated by phase $P_i$ when the unit signals are summed. The initial value for the $P_i$ is set to a predefined value or a user input value.

Based on the description above, $A_x(f)$ and $A_y(f)$ are represented by the following equations specifically.

$$A_x(f) = \sum_{i=1}^{k} \sqrt{U_x(f)_i^2 + U_y(f)_i^2} \cos\left(\tan^{-1}\left(\frac{U_y(f)_i}{U_x(f)_i}\right) + P_i\right) \tag{5}$$

$$A_y(f) = \sum_{i=1}^{k} \sqrt{U_x(f)_i^2 + U_y(f)_i^2} \sin\left(\tan^{-1}\left(\frac{U_y(f)_i}{U_x(f)_i}\right) + P_i\right) \tag{6}$$

Then, the input signal spectrum calculated in step S24 is retrieved from the memory to calculate an error E between the input signal spectrum and the approximate signal spectrum (S32). In this embodiment, the error E is calculated for the spectra of both input signal and approximate signal in the amplitude/phase space by following equation (7) using a least distance square algorithm.

$$E = \int_0^{\infty} \{(A_x(f) - S_x(f))^2 + (A_y(f) - S_y(f))^2\} df \quad (7)$$

The error determination block 109 determines whether the error has been minimized (S33). The determination is based on whether the error E becomes smaller than the threshold that is a given value or a user set value. The first round calculation generally produces an error E exceeding the threshold, so the process usually proceeds from step S33 to "NO". The error E and parameters for each unit signal are sent to the unit signal control block 5, where the minimization is performed.

The minimization is attained by estimating parameters of each unit signal included in the approximate signal to decrease the error E (S34). If the optional steps S25 and S26 have not been performed, in other words, the number of peaks of the power spectrum has not been detected, or if the error cannot become smaller than the admissible error value although the minimization calculations have been repeated, the number of the unit signals are increased or decreased for further calculation.

Even if the number of unit signals to be generated and the initial values for the parameters of each time variation function are arbitrary-defined, the signal analysis could be actually accomplished by the minimization steps. However, it is preferable to preset values by rough estimation in certain degree to reduce the possible computing time and to avoid obtaining the local solution during the minimization steps.

In this embodiment, Newton-Raphson algorithm is used for minimization. To explain it briefly, when a certain parameter is changed from one value to another value, errors E and E' corresponding respectively to before change and after change is calculated. Then, the gradient of E and E' is calculated for estimating the next parameter to decrease the error E. This process will be repeated until the error E becomes smaller than the threshold. In practice, this process is performed for all parameters. Any other algorithm such as genetic algorithm may be used for minimizing the error E.

The estimated parameters are supplied to the unit signal generation block 4, where new unit signals having the estimated parameters are generated. When the number of the unit signals have been increased or decreased in step, new unit signals are generated according to the increased or decreased number. The newly generated unit signals are processed in steps S28 through S31 in the same manner as explained above to create a new approximate signal. Then, an error between the input signal spectrum and the approximate signal spectrum in the amplitude/phase space is calculated. Thus, the calculations are repeated until the error becomes smaller than the threshold value. When it is determined that the minimum error value is obtained, the process in step S33 proceeds to "YES" and the instantaneous encoding process is completed.

The result of the instantaneous encoding is output as a set of parameters of each unit signal constituting the approximate signal when the error is minimized. A set of parameters include the center frequency, frequency time variation rate, the amplitude and amplitude time variation rate for each signal component contained in the input signal are now output.

1.4 Exemplary Results of Instantaneous Encoding

Figure 6:
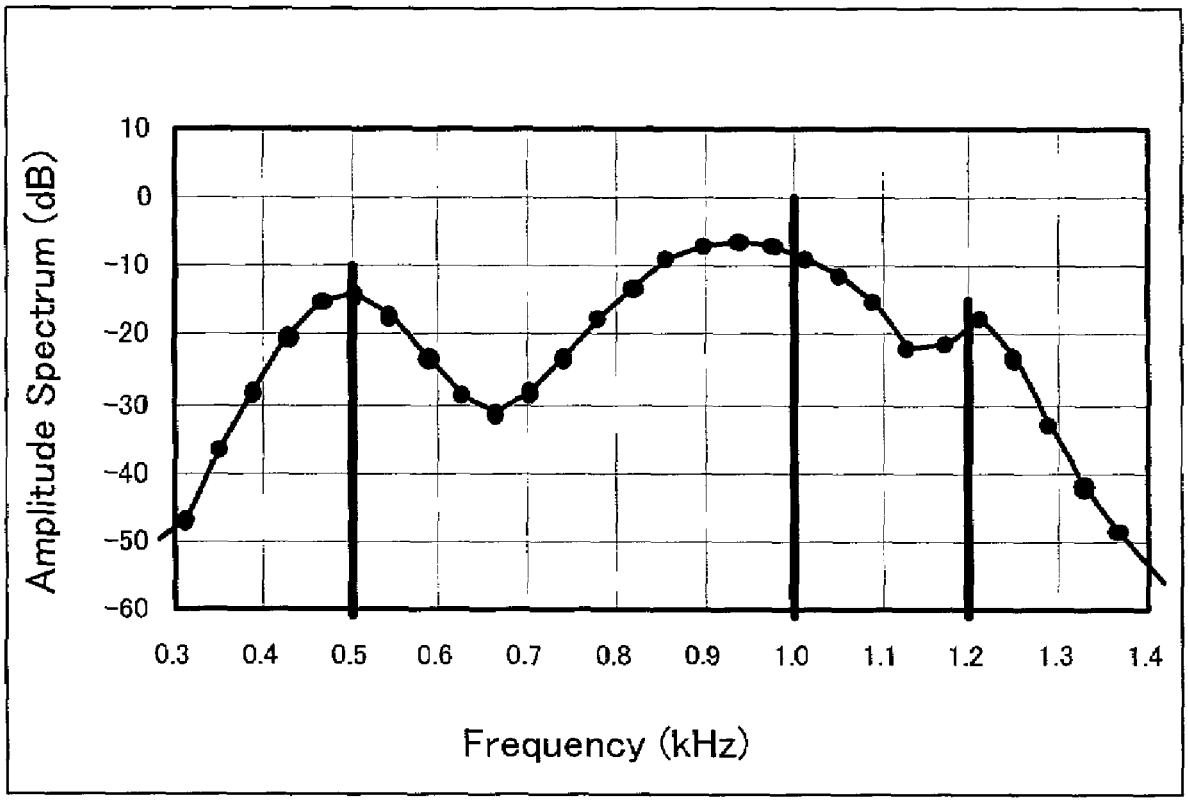
FIG. 6 illustrates the power spectrum of the input signal and the spectrum of the unit signal as a result of analyzing.
Figure 7B:
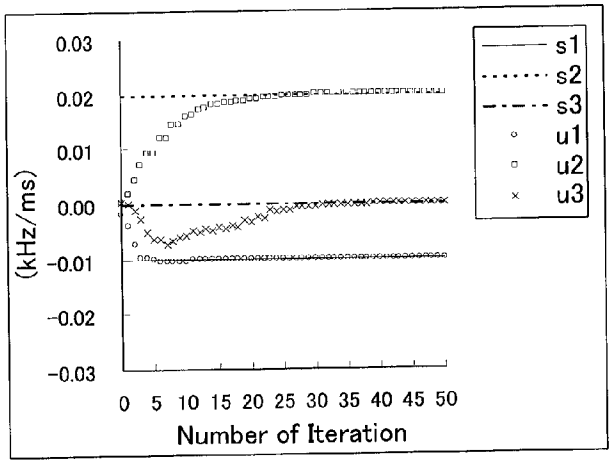
FIGS. 7A–7D are graphs of estimation process for each parameter of the unit signal when the input signal shown in FIG. 4 is analyzed.
Figure 7D:
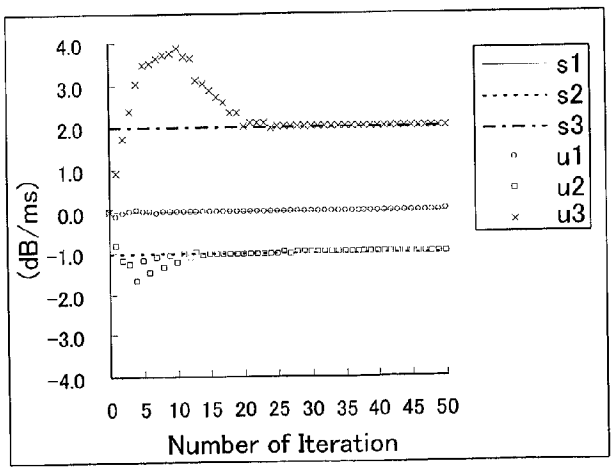
Figure 7A:
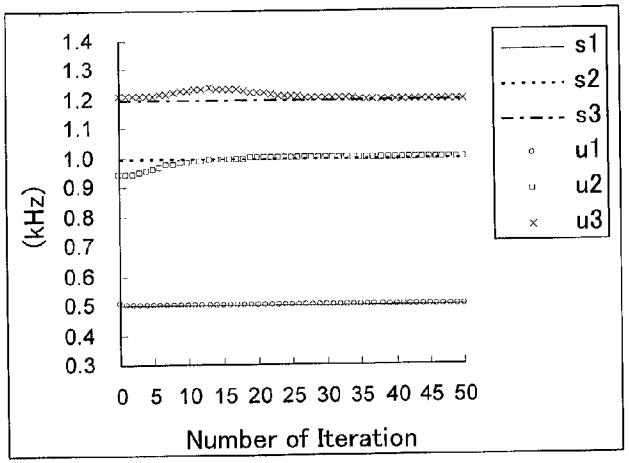
Figure 7C:
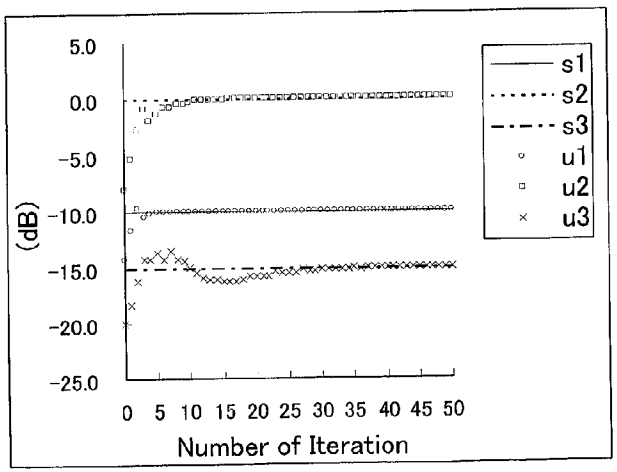

An example of the embodiments according to the invention will be described as follows. FIG. 5 is a table showing an example of input signal s(t) containing three quasi-steady signals. The s(t) is a signal is composed three kinds of signals s1, s2, s3 shown in the table. cf, df, ca and da shown in FIG. 5 are the same parameters as above explained. The power spectrum calculated when s(t) is given to the instantaneous encoding apparatus in FIG. 1 as an input signal is shown in FIG. 6. Because of the influences by the integral within a finite time range and time variation of the frequency and/or amplitude, leakage is generated and three local peaks are appeared. Then, three unit signals u1, u2, u3 corresponding to local peaks are generated by the unit signal generation block 4. Each unit signal is provided with the frequency and amplitude of the corresponding local peak as its initial values $cf_i$ and $ca_i$. $df_i$ and $da_i$ are given as initial values in this example. Such initial value corresponds to the point on which the number of iteration is zero in FIG. 7 illustrating the estimation process for each parameter.

These unit signals are added to generate an approximate signal spectrum. Then the error between the approximate signal spectrum and the input signal spectrum is calculated. After the minimization of the error is repeated, parameters in the unit signals are converged on the each optimal (minimum) value as shown in FIG. 7. It should be noted that the converged value for each parameter is very close to the parameter value for the quasi-steady signal shown in FIG. 5, and accordingly the sufficient accuracy of the result has been obtained through about 30 times of the calculations.

Referring back to FIG. 6, three bars illustrated in the graph represent the frequency and amplitude for the obtained unit signals. It is apparent that the approach according to the invention can analyze the signals contained in the input signal more precisely than the conventional approach of regarding the local peaks of the amplitude spectrum of the input signal as the frequency and the amplitude of the signal.

As noted above, in the frequency analysis of the mixed input signals, the spectrum of the signal component may be analyzed more accurately according to the invention. Frequency and/or amplitude time variation rates for a plurality of quasi-steady signal components may be obtained from a single spectrum rather than a plurality of spectra that are shifted in time. Furthermore, amplitude spectrum peaks may be accurately obtained without relying on the resolution of the discrete Fourier transform (the frequency interval).

2. Sound Separation

Figure 8:
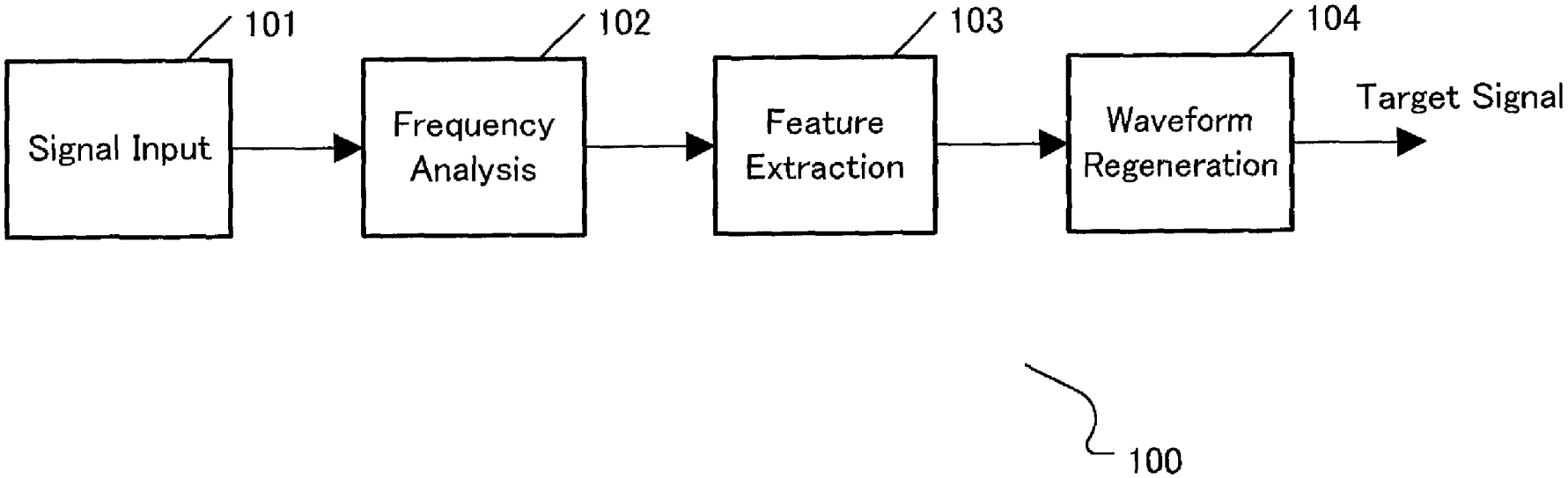
FIG. 8 is a block diagram of a sound separation apparatus according to first embodiment of the invention.

Now a sound separation apparatus according to the invention is described in detail 2.1 Structure of First Embodiment of Sound Separation Apparatus FIG. 8 shows a block diagram of a sound separation apparatus 100 according to the first embodiment of the invention. The sound separation apparatus 100 comprises a signal input block 101, a frequency analysis block 102, a feature extraction block 103 and a signal composition block 104. The sound separation apparatus 100 analyzes various features contained in a mixed input signal in which noises and signals from various sources are intermixed, and adjusts consistencies among those features to separate a target signal. Essential parts of the sound separation apparatus 100 is implemented, for example, by executing program which includes features of the invention on a computer or workstation comprising I/O devices, CPU, memory, external storage. Some parts of the sound separation apparatus 100 may be implemented by hardware components. Accordingly, the sound separation apparatus 100 is represented in functional blocks in FIG. 8.

To the signal input block 101, a mixed input signal is input as an object of sound separation. The signal input block 101 may be one or more sound input terminals, such as microphones, for directly collecting the mixed input signal. Using two or more sound input terminals, it is possible to implement embodiments utilizing sound source direction as a feature of target signal as explained later in detail. In another embodiment, a sound signal file prepared in advance may be used instead of the mixed input signal. In this case, such sound signal file would be received by the signal input block 101.

In the frequency analysis block 102, the signal received by the signal input block 101 is first converted from analog to digital. The digitized signal is frequency-analyzed with an appropriate time interval to obtain frequency spectrum at each time. Then the spectrums are arranged in a time-series to create frequency-time map (f-t map). This frequency analysis may be performed with Fourier transform, wavelet transform, or band-pass filtering and so on. The frequency analysis block 102 further obtains local peaks of each amplitude spectrum.

The feature extraction block 103 receives the f-t map from the frequency analysis block 102, and extracts feature parameters from each spectrum and its local peaks. The feature extraction block 103 estimates which feature parameters have been produced from a target signal among those extracted feature parameters.

The signal composition block 104 regenerates waveform of the target signal from the estimated feature parameters using template waveforms such as sine waves.

The target signal regenerated in such way is sent to a speaker (not shown) for playing or sent to a display (not shown) for indicating spectrum of the target signal.

2.2 Detailed Description of Feature Extraction Block

The mixed input signal contains various feature parameters of signals emitted from each sound source. These feature parameters can be classified into several groups. Those groups include global features which appear globally in time frequency range such as pitch, modulation or intonation, local features which appear locally in time frequency range such as sound source location information, or instantaneous features which appear instantaneously such as maximum point of amplitude spectrum and its time variation. These features can be hierarchically represented. And feature parameters for signals emitted from same source are considered to have certain relatedness each other. Based on such observation, the inventors of this application construct the feature extraction block hierarchically and arrange layers each of which handles different feature parameters. The feature parameter in each layer is updated to keep the consistency among the layers.

Figure 9:
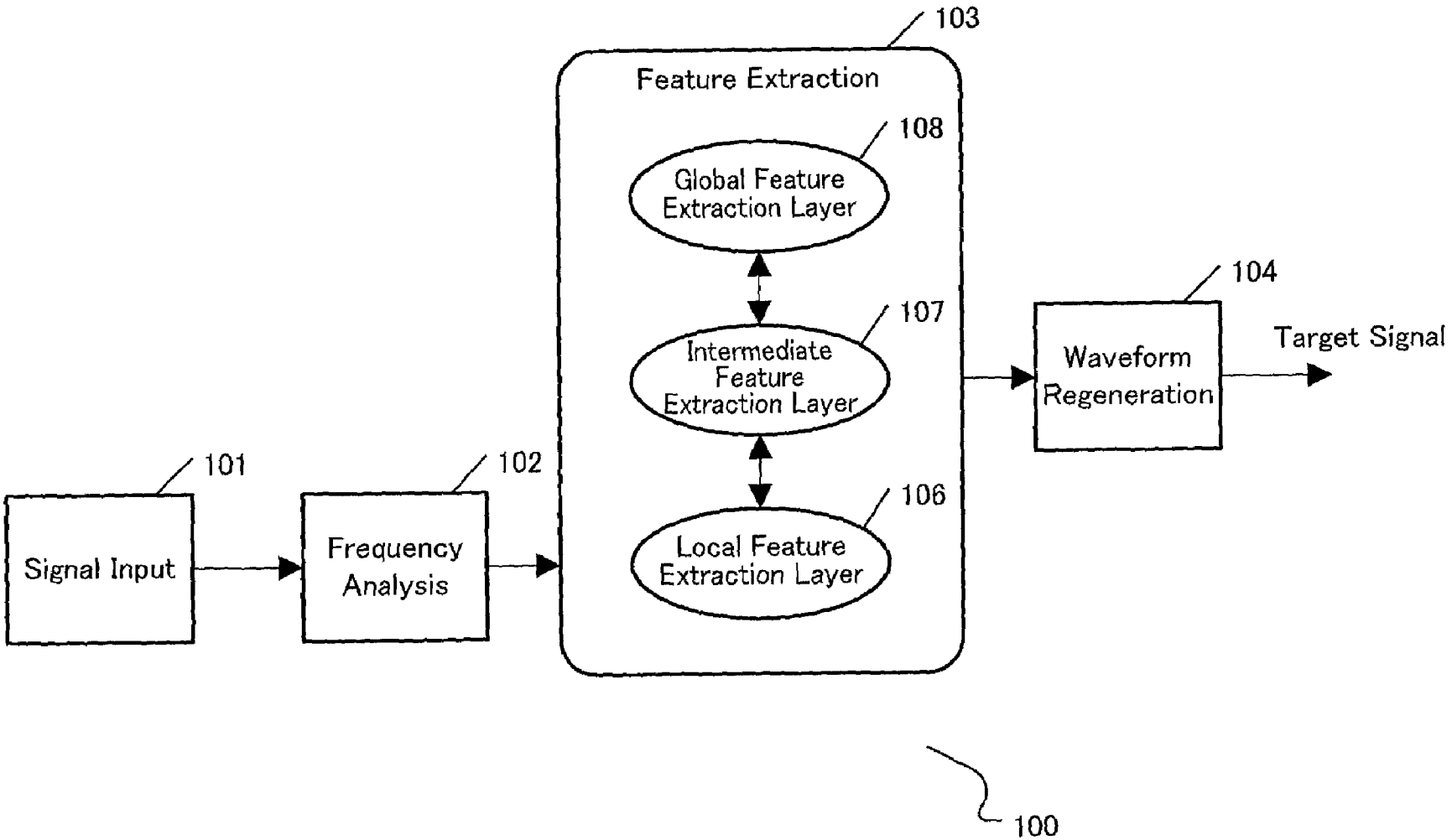
FIG. 9 shows hierarchical structure of a feature extraction block.

FIG. 9 illustrates the sound separation apparatus 100 in a case where the feature extraction block 103 includes three layers. The three layers are a local feature extraction layer 106, an intermediate feature extraction layer 107, and a global feature extraction layer 108. It should be noted that the feature extraction block 103 may include four or more layers or only two layers depending on the type of the feature parameters for extraction. Some layers may be arranged in parallel as described below in conjunction with second and third embodiments.

Each layer of the feature extraction block 103 analyzes different feature parameters respectively. The local feature extraction layer 106 and the intermediate feature extraction layer 107 are logically connected, and the intermediate feature extraction layer 107 and the global feature extraction layer 108 are logically connected as well. The f-t map created by the frequency analysis block 102 is passed to the local feature extraction layer 106 in the feature extraction block 103.

Each layer first calculates feature parameters extracted at own layer based on the feature parameters that are passed from the lower adjacent layer. The calculated feature parameters are supplied to both lower and upper adjacent layers. The feature parameters are updated to keep the consistency of the feature parameters between the own layer and the lower and upper layers.

When the best consistency is gained between the own layer and the lower and upper layers, the feature extraction block 103 judges that optimum parameters has been obtained and outputs the feature parameters as an analysis result for regenerating a target signal.

2.3 Consistency Calculation in Feature Extraction Layer

Figure 10:
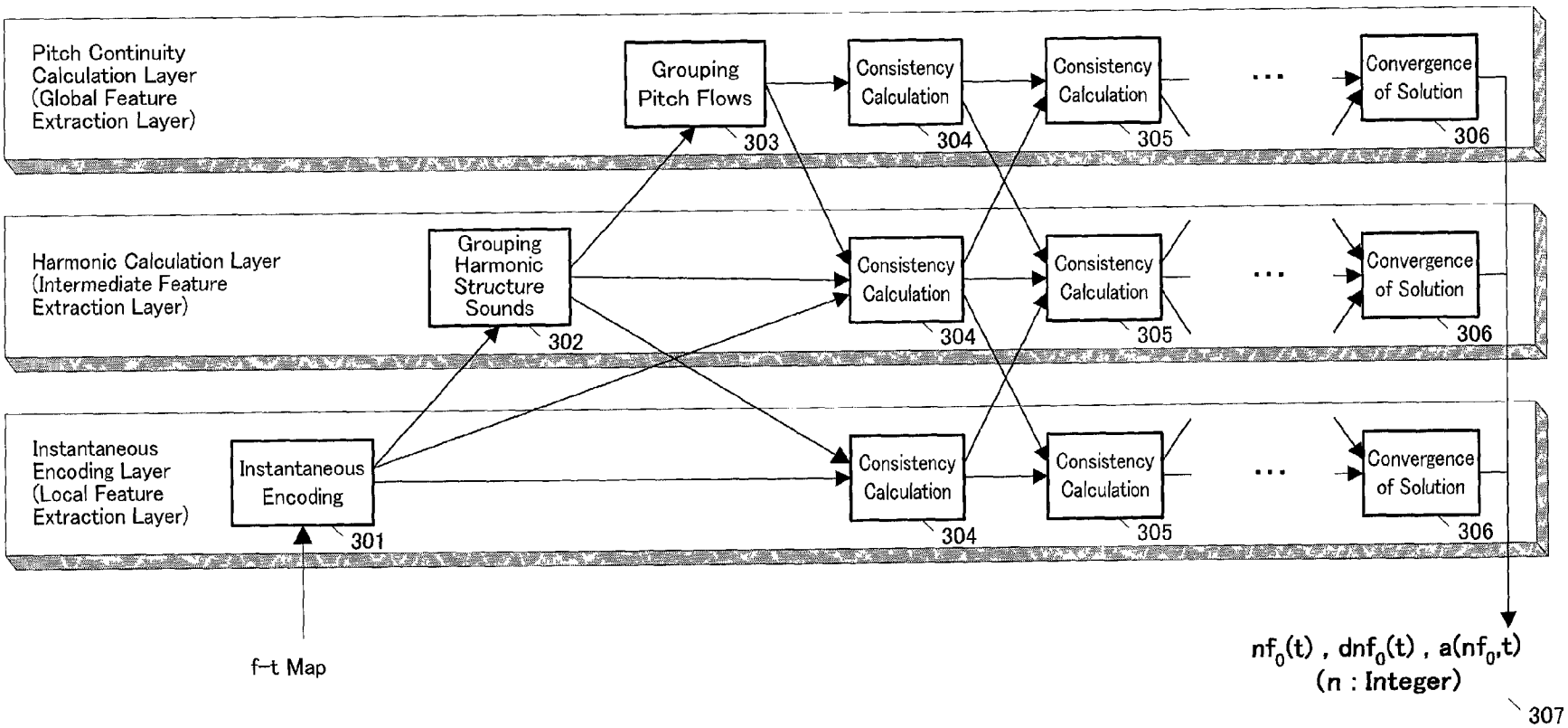
FIG. 10 is a block diagram of processes performed in each layer of the feature extraction block.

FIG. 10 shows an exemplary combination of the feature parameters extracted by each layer and process flow in each layer in the feature extraction block 103. In this embodiment, the local feature extraction layer 106 performs instantaneous encoding, the intermediate feature extraction layer 107 performs a harmonic calculation, and the global feature extraction layer 108 performs a pitch continuity calculation.

The instantaneous encoding layer (local feature extraction layer) 106 calculates frequencies and amplitudes of frequency component candidate points contained in the input signal and their time variation rates based on the f-t map. This calculation may be implemented according to, for example, the instantaneous encoding method disclosed above. However, other conventional method may be used.

The instantaneous encoding layer 106 receives as an input the feature parameters of harmonic structure calculated by the harmonic calculation layer 107 and checks the consistency of those parameters with the feature parameters of instantaneous information obtained by own layer.

The harmonic calculation layer (the intermediate feature extraction layer) 107 calculates harmonic feature of the signal at each time based on the frequencies and their time variation rates calculated by the instantaneous encoding layer 106. More specifically, frequency component candidate points having frequencies that are integral multiple $n \cdot f_0(t)$ of a fundamental frequency $f_0(t)$ and having variation rates that are integral multiple $n \cdot df_0(t)$ of a time variation rate $df_0(t)$, are grouped in a group of a same harmonic structure sound. Output from the harmonic calculation layer 107 is the fundamental frequency of the harmonic structure sound and its time variation rate. The harmonic calculation layer receives fundamental frequency information for each time that has been calculated by the pitch continuity calculation layer 108 and checks the consistency of such information with the feature parameters calculated by the harmonic calculation layer.

Because the harmonic calculation layer selects the harmonic structure sound at each point of time, it is not required to store in advance the fundamental frequency in contrast to comb filter.

The pitch continuity calculation layer (the global feature extraction layer) 108 calculates a time-continuous pitch flow from the fundamental frequencies and their time variation rates calculated by the harmonic calculation layer. If a pitch frequency and its time variation rate at a given time are calculated, approximate values of the pitch before and after that given time can be estimated. Then, if an error between such estimated pitch and the pitch actually existing at that time is within a predetermined range, those pitches are grouped as a flow of pitches. The output of the pitch continuity calculation layer is flows of the pitches and amplitudes of the frequency components constituting the flows.

The process flow performed in each layer will be described.

First, instantaneous encoding calculation is performed on the f-t map obtained in the frequency analysis block to calculate frequencies f of the frequency component candidate points contained in the input signal as well as the time variation rates df for those frequencies as feature parameters (S301). The frequencies f and the time variation rates df are sent to the harmonic calculation layer.

The harmonic calculation layer examines the relation among the frequencies corresponding to the frequency component candidate points at each time and the relation among the time variation rates to classify a collection of the frequency component candidate points that are all in a certain harmonic relation, that is to say, all have the same harmonic structure, into one group (this group will be referred to as "a harmonic group" hereinafter). Then, the fundamental frequency $f_0$ and its time variation rate $df_0$ for each group are calculated as feature parameters (S302). At this stage, one or more harmonic groups may exist.

Figure 11:
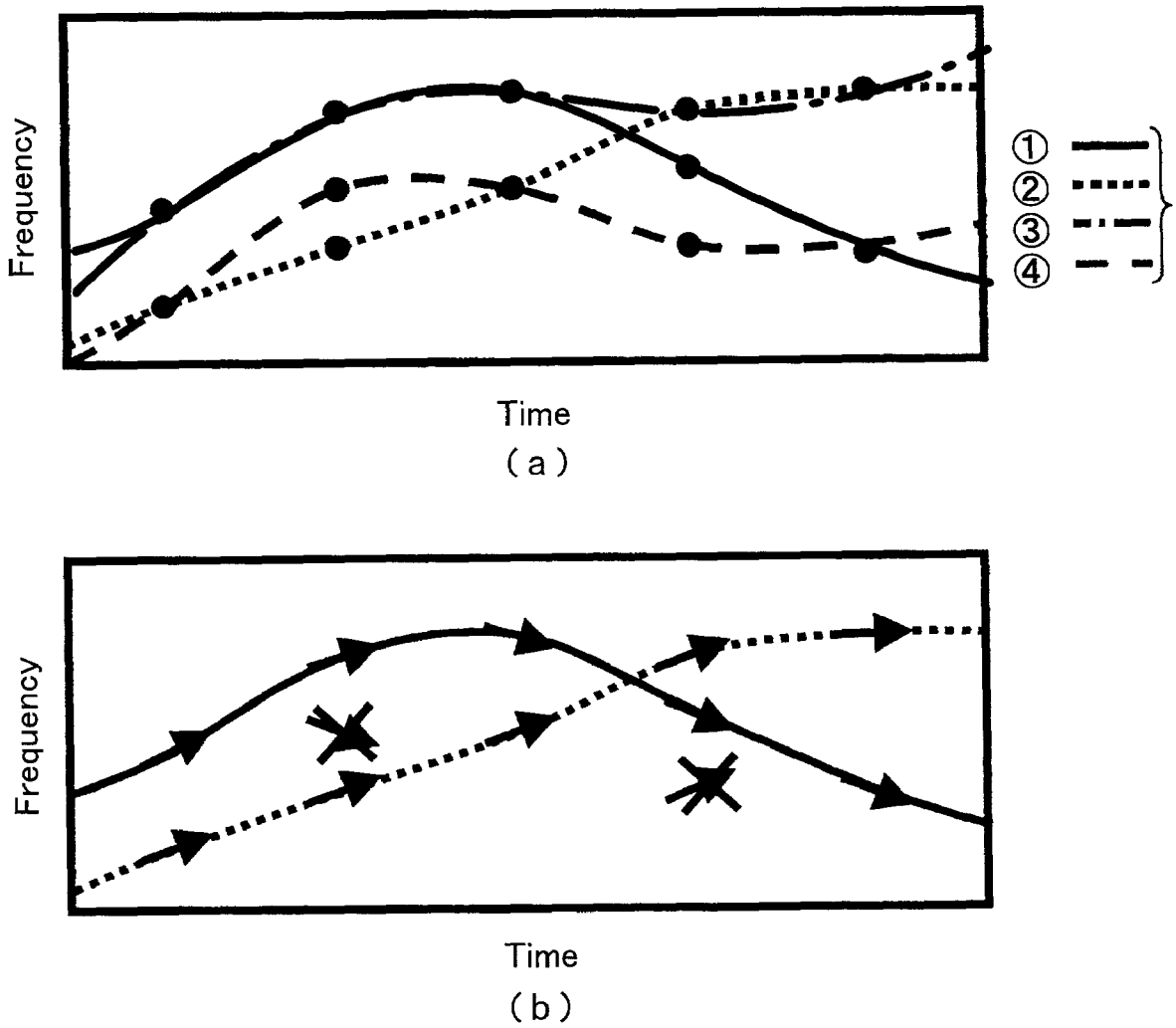
FIG. 11 shows diagrams illustrating pitch continuity detection by a conventional method and the sound separation apparatus according to the invention.

The fundamental frequency $f_0$ and its variation rate $df_0$ for the harmonic group calculated at each time point are delivered to the pitch continuity calculation layer, which compares the fundamental frequencies $f_0$ and its time variation rates $df_0$ gained at each time point over a given time period so as to estimate a pitch continuity curve that can smoothly connect those frequencies and time variation rates (S303). Feature parameters comprise the frequencies of the pitch continuity curve and their time variation rates. When some noises are contained in one target signal, logically only one pitch continuity curve should be calculated for one f-t map, but in many cases in the real environment one pitch continuity curve can not be determined uniquely as explained below with reference to FIG. 11, so a plurality of pitch continuity curves are estimated as candidates. If a mixed signal to be separated contains 2 or more sound signals, 2 or more pitch continuity curves will be estimated.

After the feature parameters are calculated in the harmonic calculation layer and the pitch continuity calculation layer, a consistency calculation is performed in each layer (S304). More specifically, the instantaneous encoding layer receives the feature parameters from the harmonic calculation layer to calculate a consistency of those parameters with its own feature parameters. The harmonic calculation layer receives the feature parameters from the instantaneous encoding layer and the pitch continuity calculation layer to calculate a consistency of those parameters with its own feature parameters. The pitch consistency calculation layer receives the feature parameters from the harmonic calculation layer to calculate a consistency of those parameters with its own feature parameters. Those consistency calculations are performed in parallel in all layers. Such parallel calculations allow each layer for establishing consistencies among the feature parameters.

Each layer updates its own feature parameters based on the calculated consistencies. Such updated feature parameters are provided to the upper and lower layers (as shown by arrows in FIG. 10) for further consistency calculations.

When consistencies have been finally accomplished among all layers, the calculation process completes (S306). Subsequently, each layer outputs the fundamental frequency $f_0(t)$ of the harmonic structure, the harmonic frequency $n \cdot f_0(t)$ (n is an integer number) contained in the harmonic structure, its variation rate $dnf_0(t)$, the amplitude $a(nf_0,t)$ and the phase $\theta(nf_0)$ at each time as the feature parameters of the target signal (S307). Then the target signal can be separated by regeneration using these results. In such way, it is possible to separate the harmonic structure sound from mixed harmonic structures by the technique of performing the overall calculations in parallel based on the consistencies among the various feature parameters.

For simplicity, harmonic structures are classified into groups by two kinds of features as frequency and its time variation in above description. However, such grouping may be performed with more features extracted in the instantaneous encoding layer. For example, it is possible to make a grouping such that the time variations of the frequencies and the amplitudes for the frequency component candidate points could be continuous by utilizing the amplitudes and their variation rates for each frequency component candidate point in addition to the frequencies and their time variation rates for each frequency component candidate point. This is because the amplitudes of the signals from the same sound source should be continuous, as well as pitches of frequencies from the same sound source are continuous.

2.4 Comparison of the Embodiment and Conventional Method

Some sound separation methods utilizing the local structure of the sound signal have been proposed. The problem of conventional methods is that it is difficult to uniquely determine which local peak at the next time should be associated with a given local peak at a certain time. This problem will be explained more specifically with reference to FIG. 11.

FIGS. 11A–11B illustrates exemplary f-t map calculated by frequency analysis upon a mixed input signal. Assume that the mixed input signal contains two continuous sound signals and instantaneous noises. Dots in FIGS. 11A–11B indicate local peaks or frequency component candidate points of the mixed input signal spectrum, respectively. FIG. 11A is the result when only the pitch continuity estimation is used like conventional methods. In this estimation, a local peak at a certain time is associated with the local peak at the next time. Repeating such association for the subsequent local peaks, a sound flow may be estimated. However, since there are several local peaks which can be connected to, it is impossible to select one uniquely. In particular, if the S/N ratio is low, the difficulty will become worse because the connection candidates in the vicinity of the target signal tend to increase.

In contrast, this embodiment according to the invention does not rely on the local peaks that may be shifted from the actual frequency components due to such factors as the shift of the discrete transform resolution, the input signal modulation and/or the adjacency of frequency components. Rather, in this embodiment, since the frequency component candidate points and their time variation rates are obtained through the instantaneous encoding scheme, the direction of the frequency can be clearly identified as illustrated by the arrows in FIG. 11B. Accordingly, the sound flows can be clearly obtained as illustrated by the solid and broken lines in FIG. 11B, so that such frequency component candidate points as shown by two X symbols can be separated as noises.

Furthermore, this embodiment takes notice of the fact that sound features contained in the sound signals emitted from the same source are related each other and the features do not vary significantly to keep the consistency. Therefore, even though sound signals are intermixed with unsteady noises, the sound signals can be separated by using the consistency of them. And even though frequency and/or amplitude of sound signals emitted from the same source changes moderately, the sound signals may be separated by using global feature parameters.

By extracting in parallel various feature parameters having different properties and associating them each other, it is possible to complement uncertain factors mutually for the input signals even if the features for those input signals cannot be precisely extracted individually, so that the overall accuracy of the feature extraction could be improved.

2.5 Computing Elements 2.5.1 Feature Extraction Block and Computing Elements

In the embodiment according to the invention, each layer is composed of one or more computing elements. A "computing element" herein is not intended to indicate any physical element but to indicate an information processing element that is prepared with one by one corresponding to the feature parameters and is capable of performing same process individually and of supplying the feature parameters mutually with other computing elements.

Figure 12:
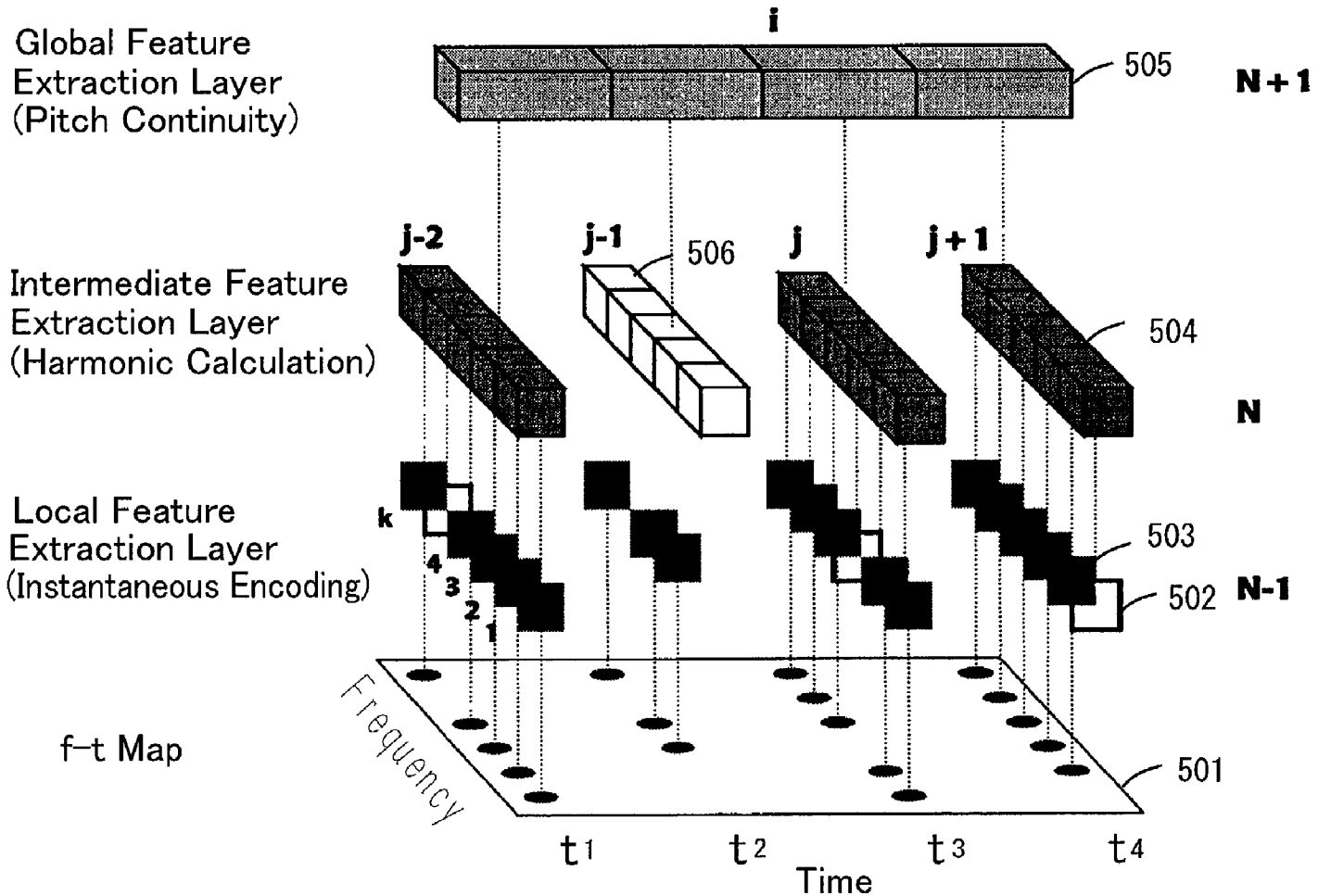
FIG. 12 is a block diagram of exemplary composition of calculation elements in the feature extraction block.

FIG. 12 is a block diagram for illustrating an exemplary composition of each layer with computing elements. From top to bottom, computing elements for a global feature extraction layer, an intermediate feature extraction layer and a local feature extraction layer are presented in this order. In following description, FIG. 12 will be explained in case of specific combination of the features (shown in the parentheses in FIG. 12) according to the embodiment noted above. However, any other combination of features may be used.

An exemplary f-t map 501 is supplied by the frequency analysis block. Block dots shown in the f-t map 501 indicate 5, 3, 5 or 5 frequency component candidate points for time $t_1$, $t_2$, $t_3$ or $t_4$ respectively.

On the local feature extraction layer (instantaneous encoding layer), computing elements are created corresponding to the frequency component candidate points on the f-t map 501. Those computing elements are represented by black squares (for example, 503) in FIG. 12. On the intermediate feature extraction layer (harmonic calculation layer), one computing element is created for one group of the computing elements on the local feature layer, where each group includes the computing elements in same harmonic structure. Harmonic structures are observed in FIG. 12 for time $t_i$, $t_3$ and $t_4$ respectively, so three computing elements j−2, j and j+1 are created on the intermediate feature extraction layer. These computing elements are represented by rectangular solids (for example, 504) in FIG. 12. As to time $t_2$, a computing element j−1 is not created at this time because harmonic structure may not be observed due to less number of the frequency component candidate points.

On the global feature extraction layer (pitch continuity), computing elements is created for any group that is recognized to have a pitch continuity over the time period from $t_1$ to $t_4$ based on the fundamental frequencies and their time variation rates calculated on the harmonic calculation layer. In FIG. 12, a computing element i is created since pitch continuities are recognized for the computing elements j−2, j and j+1, which is represented by an oblong rectangular solid 505.

When the validity of the computing element i becomes stronger as the consistency calculation proceeds, it will be estimated that the validity of the existence of the computing element corresponding to time $t_2$ on the intermediate feature extraction layer also becomes stronger. Therefore, computing element j−1 will be created. This computing element j−1 is represented by a white rectangular solid 506 in FIG. 12. Furthermore, when the validity of the computing elements j−2, j−1 and j+1 becomes stronger as the consistency calculation further proceeds, it will be estimated that the validity of the existence of the computing elements at such points represented by white squares (like 502) on the local feature extraction layer also becomes stronger. Therefore, computing elements for the white squares will be created.

In case of actual sound separation, many other frequency component candidate points are existed on the f-t map for other sound signals and/or noises in addition to target signal. So computing elements is created on the local feature extraction layer for all of those candidate points and corresponding computing elements is also created on the intermediate feature extraction layer for any groups of the computing elements in same harmonic structure. There is a tendency that a plurality of harmonic groups are observed in the initial period of consistency calculation because the validity of these harmonic groups are not so different. However, as the consistency calculation proceeds, the computing elements for the signal and/or noises except the target signal is eliminated because their validity is judged as relatively low. Thus, only the computing elements corresponding to the feature parameters of the target signal are survived. Same process is performed on computing elements on the global feature extraction layer.

As noted above, in the initial period of consistency calculation computing elements are created for all frequency component candidate points on the f-t map. Then as the calculation proceeds the computing elements having lower validity are eliminated and only the computing elements having higher validity may survive. It should be noted therefore that the composition of the computing elements in each layer shown in FIG. 12 are only examples and that the composition of the computing elements changes constantly as the consistency calculation proceeds. The composition of the computing elements shown in FIG. 12 should be considered to correspond with the case where only one harmonic structure has been observed at each time, or the case after the calculating elements having lower validity have been eliminated due to the progress of the consistency calculations.

2.5.2 Operations in Computing Elements

Figure 13:
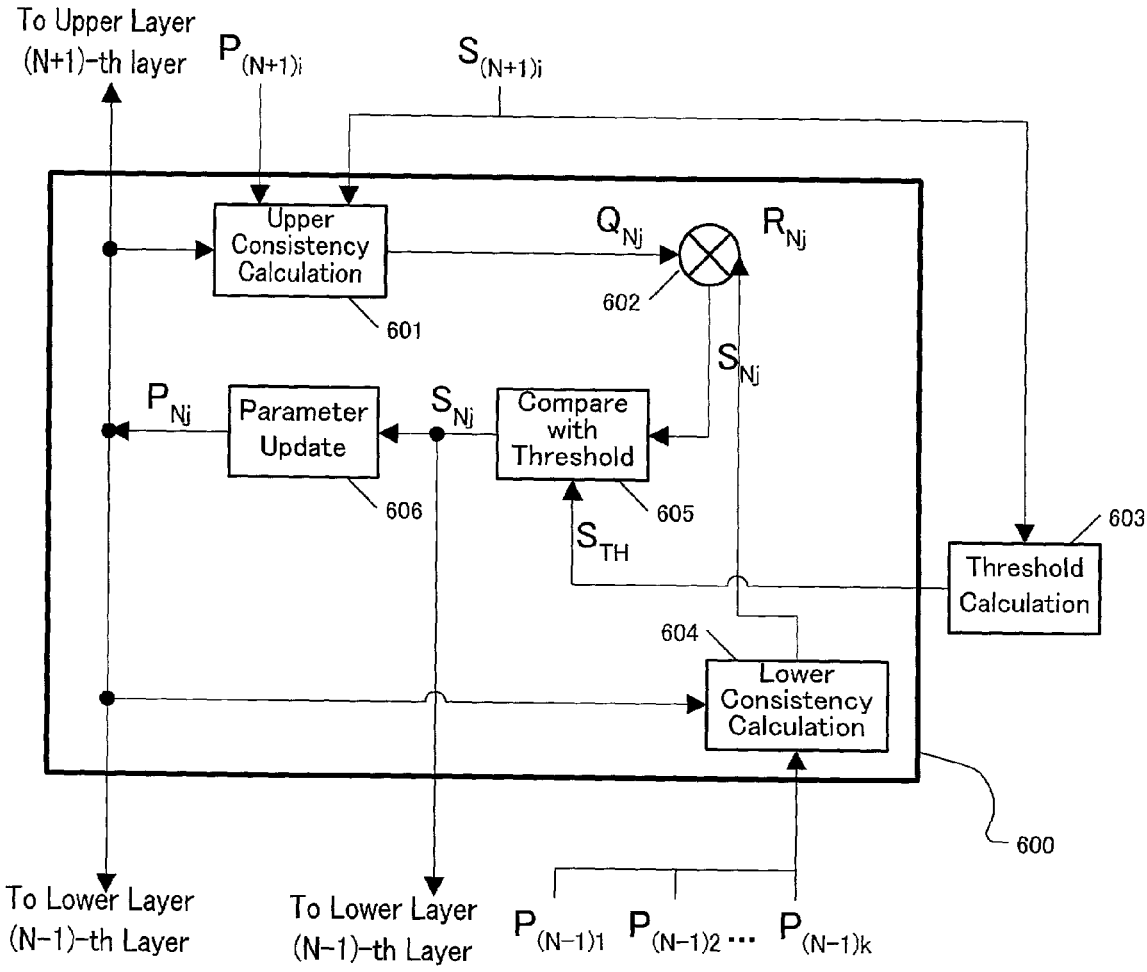
FIG. 13 is a block diagram of one embodiment of the calculation element.

FIG. 13 is an exemplary block diagram illustrating a computing element 600. Following description will make reference to N-th layer including the computing element 600. One level lower layer than N-th layer is referred to as (N−1)-th layer and one level upper layer than N-th layer is referred as (N+1)-th layer. The suffix of the computing elements of the (N+1)-th layer, the Nth layer or the (N−1)-th layer is represented by i, j or k, respectively.

A lower consistency calculation block 604 evaluates the difference between parameters $P_{Nj}$ and parameters $P_{N-1}$. Then the block 604 calculates a consistency $R_{Nj}$ with the feature parameters $P_{Nj}$ of the N-th layer according to the following Bottom-Up function (BUF):

$$R_{Nj} = BUF(P_{Nj}) = \frac{1}{1 + (P_{Nj} - P_{N-1})^2} \quad (8)$$

An upper consistency calculation block 601 calculates a consistency $Q_{Nj}$ between the set of feature parameters $P_{(N+1)i}$ calculated in each computing element in the upper (N+1)-th layer and the feature parameters $P_{Nj}$ of the N-th layer according to the following Top-Down function (TDF):

$$Q_{Nj} = TDF(P_{Nj}) = \frac{1}{1 + S_{(N+1)_i} \cdot (P_{Nj} - P_{(N+1)_i})^2} \quad (9)$$

where $S_{(N+1)i}$ represents a validity indicator for the (N+1)-th layer (this validity indicator will be explained later).

The number of the parameters depend on the number of the computing elements contained in each layer. In case of the intermediate feature extraction layer in FIG. 12, the number of the parameters supplied from the (N−1)-th layer is "k" and the number of the parameters supplied from the (N+1)-th layer is "1".

The consistency functions $Q_{Nj}$ and $R_{Nj}$ calculated in the consistency calculation blocks 601 and 604 respectively are multiplied in a multiplier block 602 to obtain the validity indicator $S_{Nj}$. The validity indicator $S_{Nj}$ is a parameter to express a degree of certainty of the parameter $P_{Nj}$ of the computing element j in the N-th layer. The validity indicator $S_{Nj}$ may be represented as an overlapping potion of the consistency functions $Q_{Nj}$ and $R_{Nj}$ in the parameter space.

A threshold calculation block 603 calculates a threshold value $S_{th}$ with a threshold value calculation function (TCF) for all of the computing elements on the N-th layer. The threshold value $S_{th}$ is initially set to a relatively small value with reference to the validity indicator $S_{(N+1)i}$ of the upper layer. It may be set to a larger value gradually as the convergence of the calculations. The threshold calculation block 603 is not included in the computing element 600, but prepared in each layer.

A threshold comparison block 605 compares the threshold value $S_{th}$ with the validity indicator $S_{Nj}$. If the validity indicator $S_{Nj}$ is less than the threshold value $S_{th}$, it means that the validity of the existence of the computing element is relatively low and accordingly this computing element is eliminated.

A parameter update block 606 updates the parameters $P_{Nj}$ to maximize the validity indicator $S_{Nj}$. The updated parameters $P_{Nj}$ are passed to the computing elements on the (N+1)-th and (N−1)-th layers for the next calculation cycle.

Figure 14:
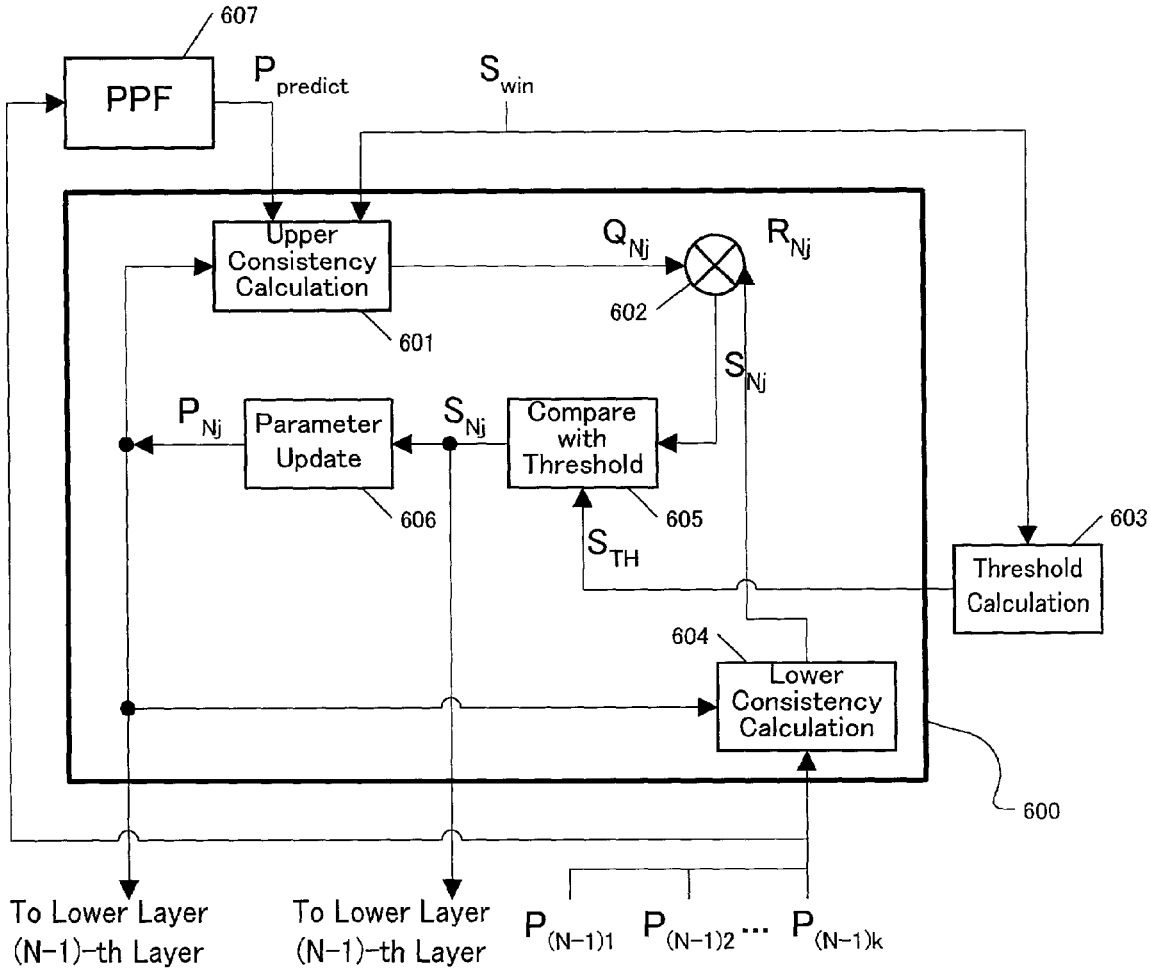
FIG. 14 is a block diagram of another embodiment of the calculation element.

Although the composition of the computing elements on topmost layer in the feature extraction block is same as shown in FIG. 13, the parameters to be input to those computing elements are different as shown in FIG. 14. In this case, the validity indicator $S_{win}$ of the computing element having the highest validity among the computing elements on the global feature extraction layer is used instead of the validity indicator $S_{(N+1)j}$ from the upper layer. Also, instead of the parameters from the upper layer, the parameters from the lower layer are used to calculate predicted parameter ($P_{predict}$) by a parameter prediction function (PPF) 607 for obtaining the consistency function $Q_{Nj}$ and the threshold value $S_{th}$. Thus, the top-down funtion (TDF) may be revised as follows.

$$Q_{Nj} = TDF(P_N) = \frac{1}{1 + S_{win} \cdot (P_N - P_{predict})^2} \quad (10)$$

The computing element having the high validity indicator $S_{Nj}$ has a strong effect on the TDF of the computing elements on the lower (N−1)-th layer and increases each validity indicator of the computing elements on the lower layer. On the other hand, the computing element having the low validity indicator $S_{Nj}$ has a weak effect and is eliminated when the validity parameter $S_{Nj}$ becomes less than the threshold value $S_{th}$. The threshold value $S_{th}$ is re-calculated whenever the validity indicator changes. And, the TCF is not fixed but may change as the progress of the calculation. In such way, many computing elements (that is, candidates of many feature parameters) may be maintained while the consistency calculation is in its initial stage. As the consistency among each layer becomes stronger, the survival condition (that is, the threshold value $S_{th}$) may be set higher to improve the accuracy of the feature parameters in comparison with the fixed threshold value.

2.5.3 Process of Computing Elements

Figure 15:
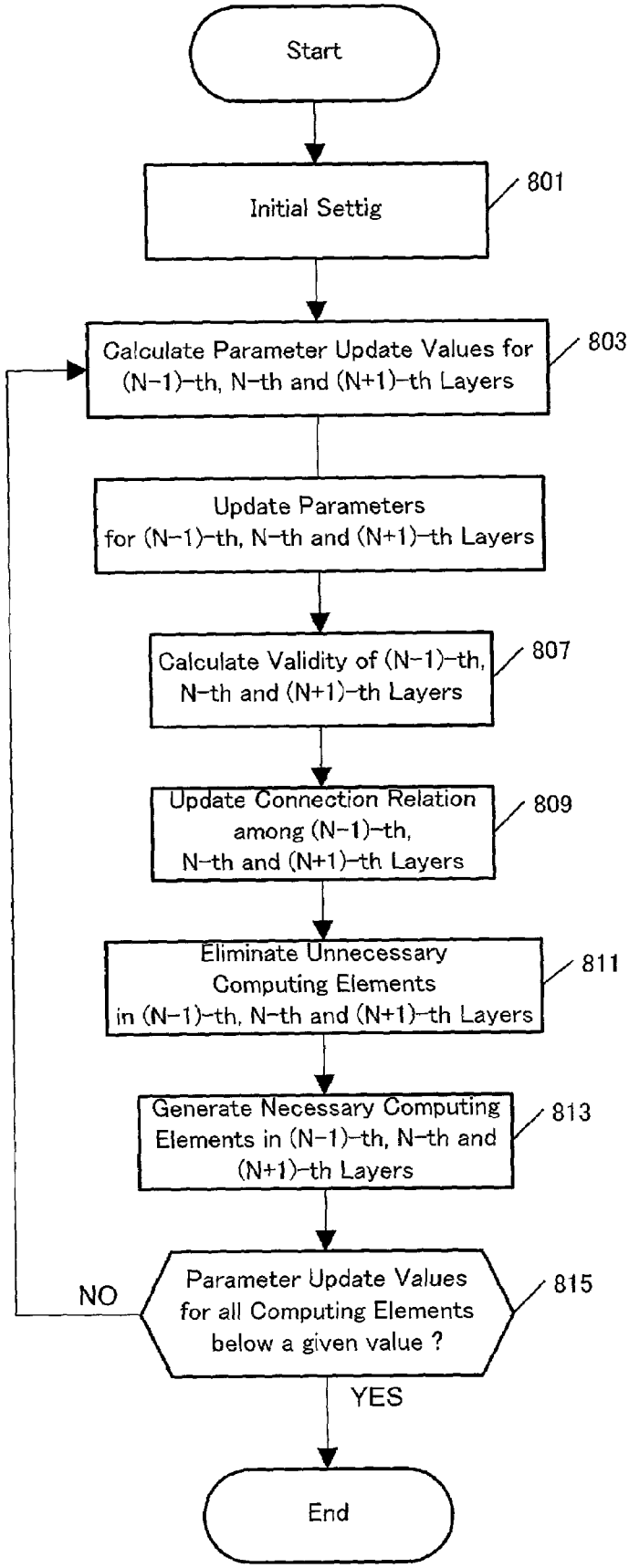
FIG. 15 is a flow chart of the process in the feature extraction block shown in FIG. 12.

FIG. 15 is a flow chart of the calculation process in the feature extraction block comprising the (N−1)-th, N-th and (N+1)-th layers, which are composed of the computing elements noted above.

Initial settings are performed as required (S801). Parameter update values of computing elements on the (N−1)-th, N-th and (N+1)-th layers are calculated based on the parameter data input from upper and lower layers (S803). Then the parameters of the computing elements in each layer are updated (S805). Validity indicators are also calculated (S807).

Based on the calculated parameters, connection relation of each layer is updated. At this time, the computing elements having a validity indicator less than the threshold value is eliminated (S811) and new computing elements are created as needed (S813).

When the parameter update values of all computing elements become less than a given value (S815), consistency among the layers are judged as reaching to sufficient value and accordingly the consistency calculation is completed. If any update parameter value of the computing elements still exceeds the given value, the update values should be calculated again (S803), and subsequent calculations are repeated.

2.6 Second Embodiment of Sound Separation Apparatus

Feature parameters extracted in each layer is not limited to the combination noted above with the first embodiment of the invention. Feature parameters may be allocated to each of local, intermediate and global feature extraction layers according to the type of features. Any other features which may be used for feature extraction include on-set/off-set information or intonation. These feature parameters are extracted by any appropriate methods and are updated among the layers to accomplish the consistency in a same manner of the first embodiment.

Figure 16:
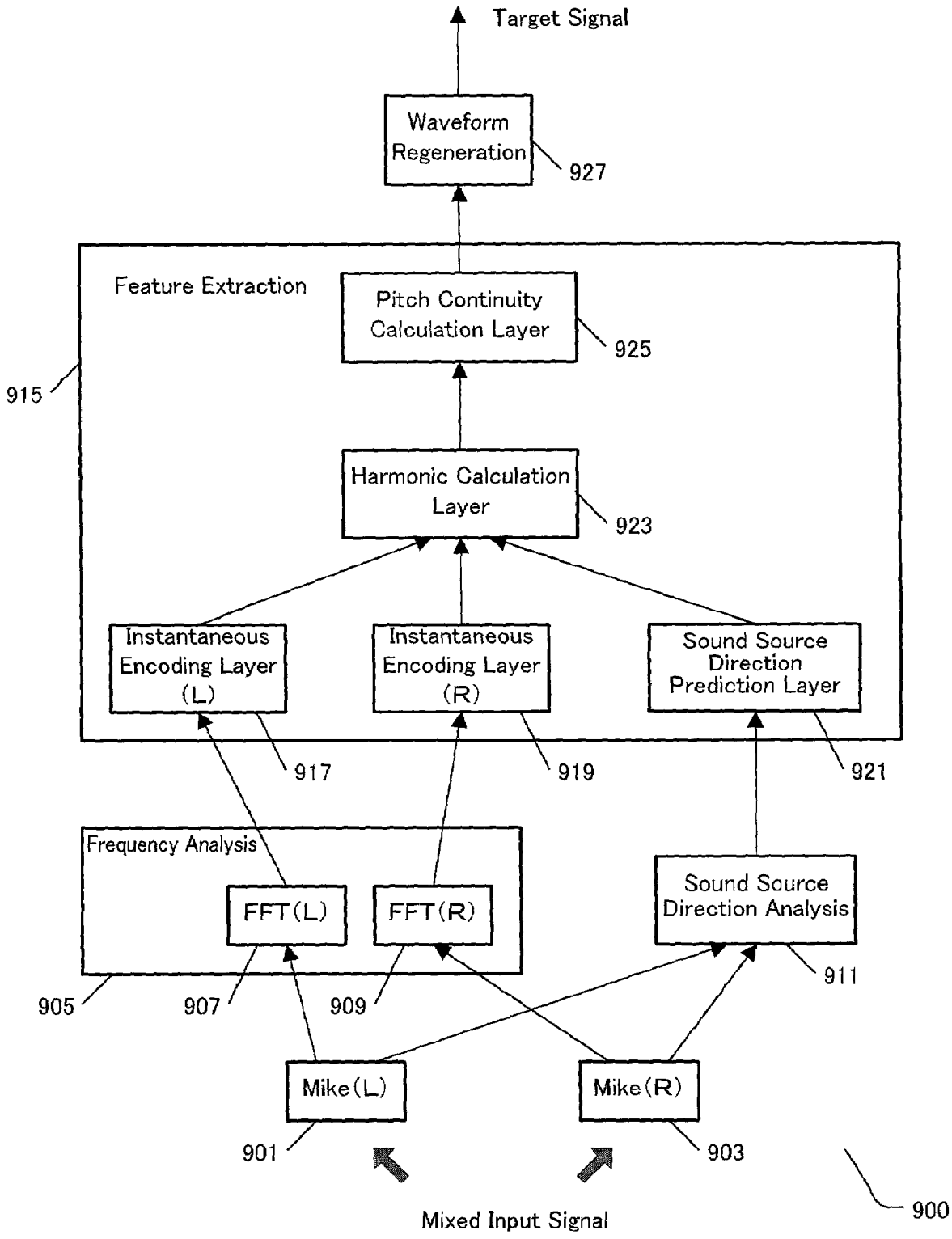
FIG. 16 is a block diagram of a sound separation apparatus according to second embodiment of the invention.

The second embodiment of the invention may utilize sound source direction as a feature by comprising two sound input terminals as shown in FIG. 16. In this case, a sound source direction analysis block 911 is additionally provided as shown in FIG. 16 to supply the source direction information to the feature extraction block 915. Any conventional method for analyzing the sound source direction may be used in this embodiment. For example, a method for analyzing the source direction based on the time difference of the sounds arriving to two or more microphones, or a method for analyzing the source direction based on the differences in arrival time for each frequency and/or the differences in sound pressure after frequency-analyzing for incoming signals may be used.

The mixed input signal is collected by two or more sound input terminals to analyze the direction of the sound source (two microphones L and R 901, 903 are shown in FIG. 16). Frequency analysis block 905 analyze the signals with FFT collected through the microphones 901, 903 separately to obtain f-t map.

Feature extraction block 915 comprises instantaneous encoding layers as many as the number of the microphones. In this embodiment, two instantaneous encoding layers L and R 917, 919 are provided corresponding to the microphones L and R respectively. The instantaneous encoding layers 917, 919 receive the f-t map and calculate the frequencies and amplitudes of the frequent component candidate points, and calculate time variation rates of the frequencies and amplitudes. The instantaneous encoding layers 917 and 919 also check the consistency with the frequency component candidate points using harmonic information calculated in harmonic calculation layer 923.

Sound source direction analysis block 911 receives the mixed input signal collected by the microphones L and R 901, 903. In the sound source analysis block 911, part of the input signal is extracted using time window with same width as used in the FFT. The correlation of the two signals is calculated to obtain maximum points (as represented by black dots in FIG. 17).

Feature extraction block 915 comprises a sound source direction prediction layer 921. A sound source direction prediction layer 921 selects, from the peaks of the correlation calculated by the sound source analysis block 911, those peaks having an error, which is smaller than a given value, against the line along the time direction, to estimate such selected peaks as time differences caused by the differences of sound source directions (three time differences $\tau 1$, $\tau 2$ and $\tau 3$ are predicted in the case shown in FIG. 17). These estimated arrival time differences of each target signal caused by the difference of sound source directions are passed to harmonic calculation layer 923.

The sound source direction prediction layer 921 also checks the consistency with each of the estimated arrival time differences using the time differences of harmonic information obtained from harmonic calculation layer 923.

The harmonic calculation layer 923 calculates the harmonic by adding the frequency component candidate points supplied from both of the instantaneous encoding layer (L) 917 and the instantaneous encoding layer (R) 919 after having shifted them by their arrival time differences supplied from the sound source direction prediction layer 921. More specifically, since the left and right microphones 901, 903 receive the signals having similar wave patterns that are shifted by the arrival time $\tau 1$, $\tau 2$ or $\tau 3$ respectively, it is predicted that the outputs from each of the instantaneous encoding layers 917, 919 have the same frequency component candidate points that are also shifted by the arrival time $\tau 1$, $\tau 2$ or $\tau 3$. By utilizing this prediction, the frequency components of the target signal arrived from the same sound source are emphasized. According to the sound separation apparatus 900 noted above, it is possible to improve the separation accuracy of target signals from the mixed input signal.

It should be noted that the operations of pitch continuity calculation layer 925 and signal composition layer 927 in the feature extraction block 915 are same with the blocks with FIG. 10. It should be also noted that each layer is composed with computing elements, but the computing elements in the harmonic calculation layer 923 are arranged to receive the feature parameters from several layers (that is, the instantaneous encoding layer and the sound source direction prediction layer) and calculate the feature parameters to supply them to those several layers.

2.7 Third Embodiment of Sound Separation Apparatus

Figure 18:
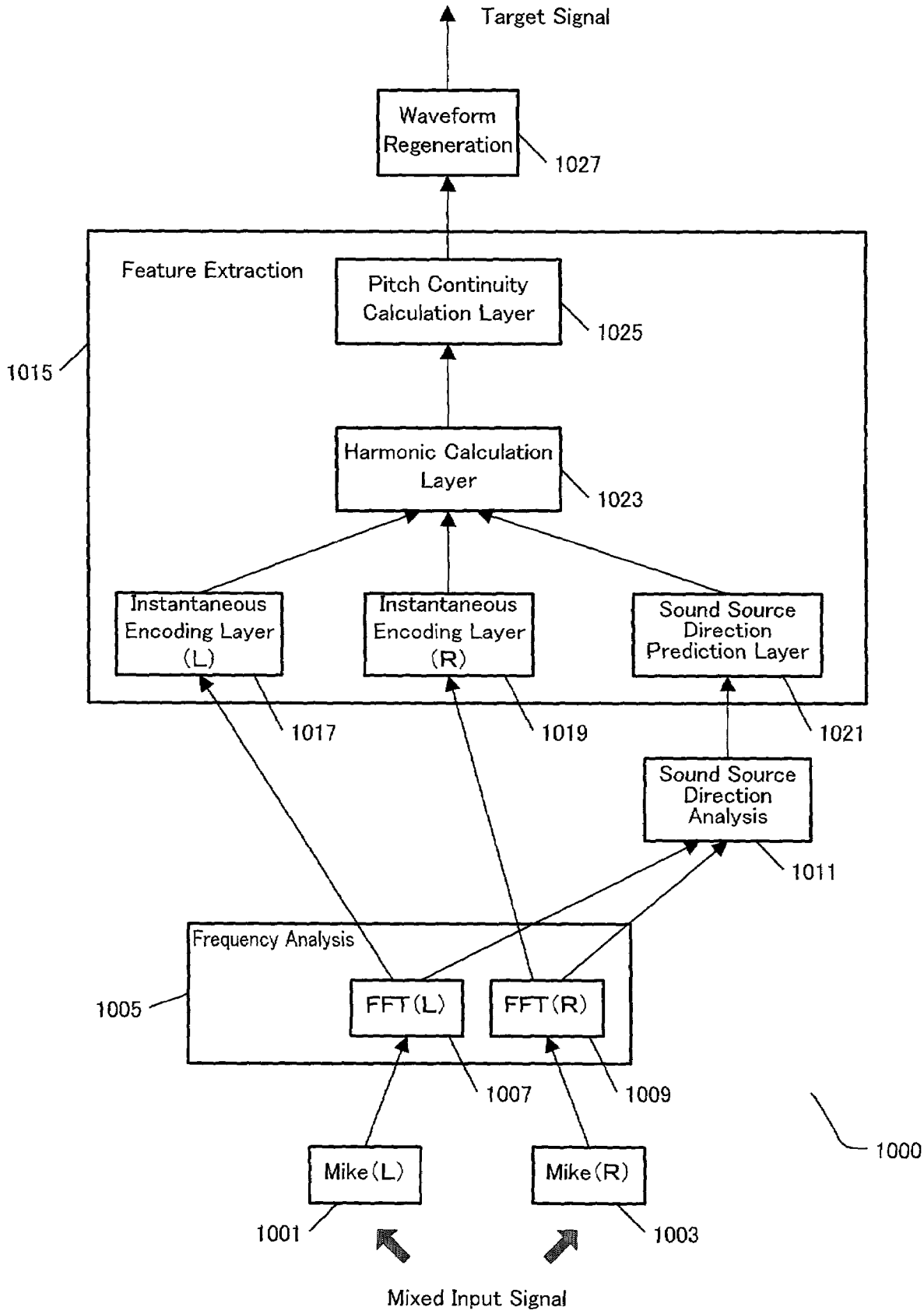
FIG. 18 is a block diagram of a sound separation apparatus according to third embodiment of the invention.

FIG. 18 illustrates a third embodiment of the sound separation apparatus 1000 according to the invention.

Figure 17:
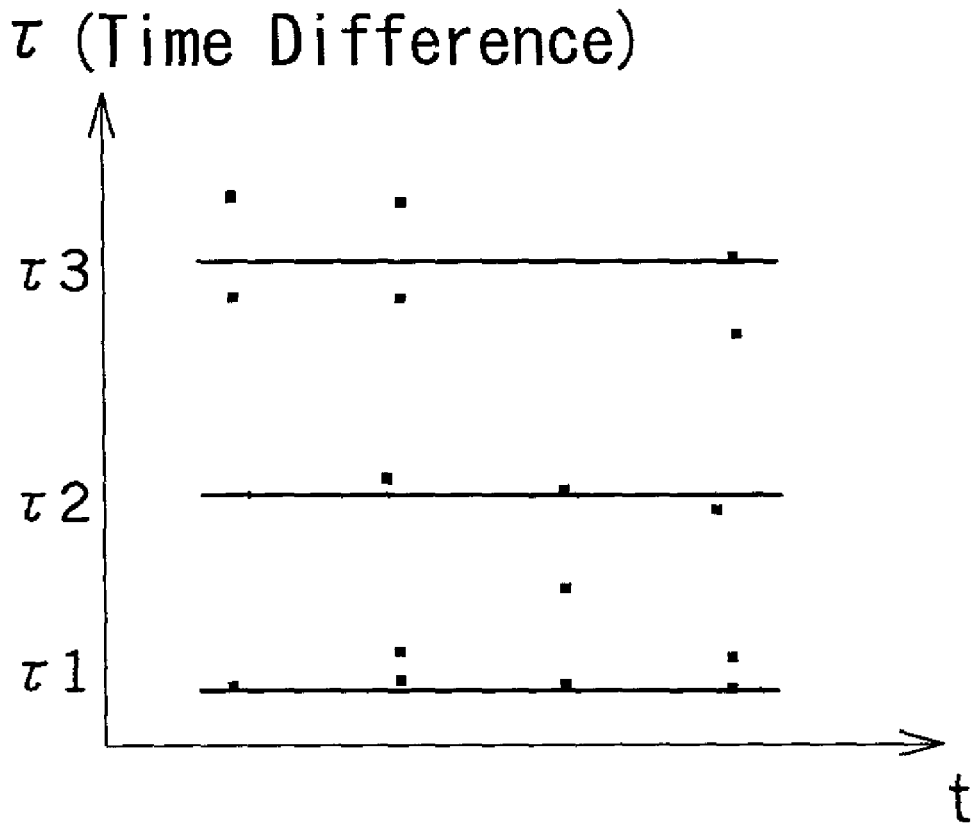
FIG. 17 illustrates how to estimate the direction of the sound source.

The mixed input signal is collected by two or more sound input terminals (two microphones L and R 1001, 1003 are shown in FIG. 17). Frequency analysis block 1005 analyzes the signals with FFT collected through the microphones 1001, 1003 separately to obtain f-t map.

Feature extraction block 1015 comprises instantaneous encoding layers as many as the number of the microphones. In this embodiment, two instantaneous encoding layers L and R 1017, 1019 are provided corresponding to the microphones L and R respectively. The instantaneous encoding layers 1017, 1019 receive the f-t map and calculate the frequencies and amplitudes of the frequent component candidate points, and calculate time variation rates of the frequencies and amplitudes. The instantaneous encoding layers 1017 and 1019 also check the consistency with the frequency component candidate points using harmonic information calculated in harmonic calculation layer 1023.

The instantaneous encoding layers 1017 and 1019 also verify the consistencies with the calculated frequency component candidate points using the harmonic information calculated in the harmonic calculation layer 1023.

Figure 19:
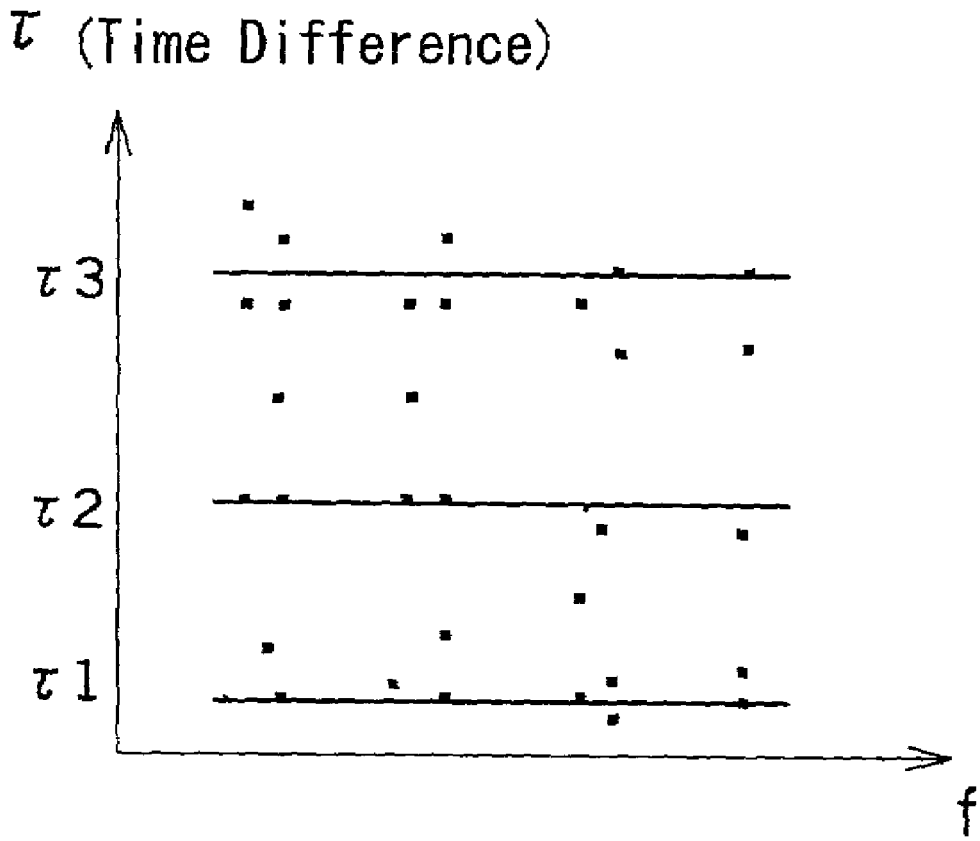
FIG. 19 illustrates how to estimate the direction of the sound source.

Sound source direction analysis block 1011 calculates the correlation in each frequency channel based on the FFT performed in the frequency analysis block 1005 to obtain local peaks (as represented by black dots in FIG. 19). The sound pressure differences for each frequency channel are also calculated.

Feature extraction block 1015 comprises a sound source direction prediction layer 1021, which receives the correlation of the signals in each frequency channel, the local peaks and the sound pressure differences for each frequency channel from the sound source direction analysis block 1011. Then the sound source direction prediction layer 1021 classifies the local peaks broadly into groups by their sound sources. Such predicted arrival time differences for each target signal caused by the difference of the sound sources are supplied to the harmonic calculation layer 1023.

The sound source direction prediction layer 1021 also checks the consistency between the estimated arrival time differences and the sound source groups using the harmonic information obtained from the harmonic calculation layer 1023.

The harmonic calculation layer 1023 calculates the harmonic by adding the frequency component candidate points supplied from both of the instantaneous encoding layer (L) 1017 and the instantaneous encoding layer (R) 1019 after having shifted them by their arrival time differences supplied from the sound source direction prediction layer 1021, and by utilizing the information of the same sound source supplied from the sound source direction prediction layer 1021.

It should be noted that the operations of the pitch continuity calculation layer 1025 and the signal composition layer 1027 in the feature extraction block 1015 are same with the blocks with FIG. 10. It should be also noted that each layer is composed with computing elements, but the computing elements in the harmonic calculation layer 1023 are arranged to receive the feature parameters from several layers (that is, the instantaneous encoding layers and the sound source direction prediction layer) and calculate the feature parameters to supply them to those several layers.

3. Exemplary Results of Sound Separation

FIGS. 20–22 illustrate the results of the target signal separation performed by the sound separation apparatus 100 of the first embodiment of the invention to mixed input signal containing target signals and noises. In FIGS. 20–22, FIG. A shows the spectrum of a target signal, FIG. B shows the spectrum of a mixed input signal containing noises, and FIG. C shows the spectrum of an output signal after eliminating the noises. In each figure the horizontal axis represents time (msec) and the vertical axis represents frequency (Hz). The ATR voice database was used to generate input signals.

Figure 20A:
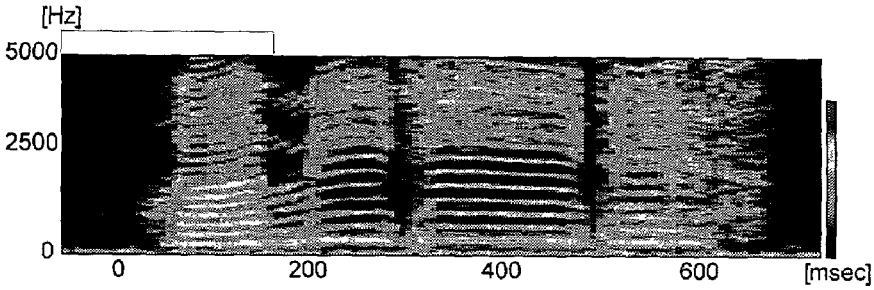
FIGS. 20A–20C show diagrams of spectra illustrating a result of sound signal separation by the sound separation apparatus according to the first embodiment.
Figure 20B:
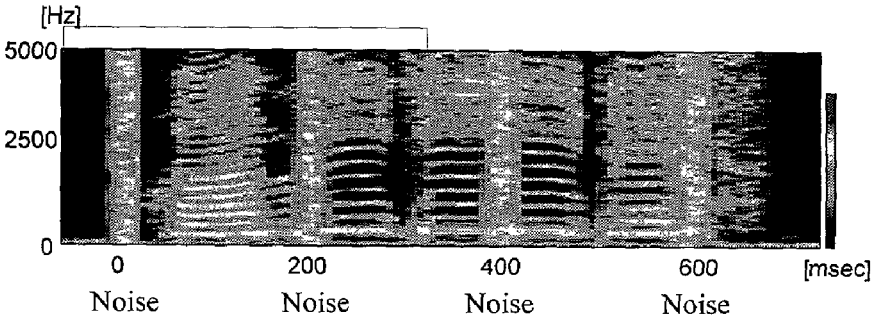
Figure 20C:
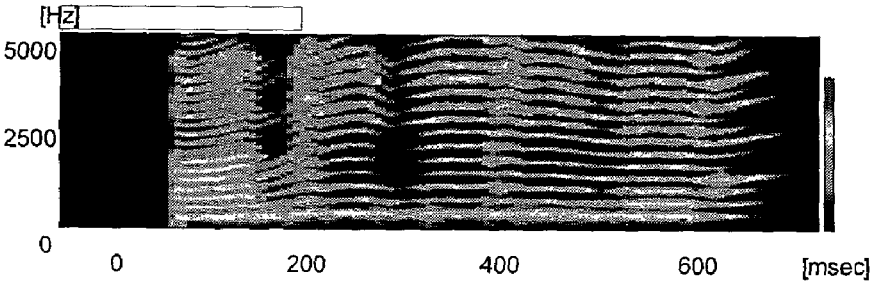

FIGS. 20A–20C illustrate the separation result in the case in which intermittent noises are intermixed with a target signal. The target signal in FIG. 20A is "family res", which is a part of "family restaurant" spoken by a female. The signal which 15 ms long white noises are intentionally intermixed to the target signal for every 200 ms is used as the input signal (shown in FIG. 20B). The output signal (shown in FIG. 20C) is produced by regenerating the waveform based on the feature parameters extracted from the input signal by the first embodiment. It will be apparent in FIG. 20 that the white noises have been removed almost completely in the output signal as contrasted with the input signal.

Figure 21A:
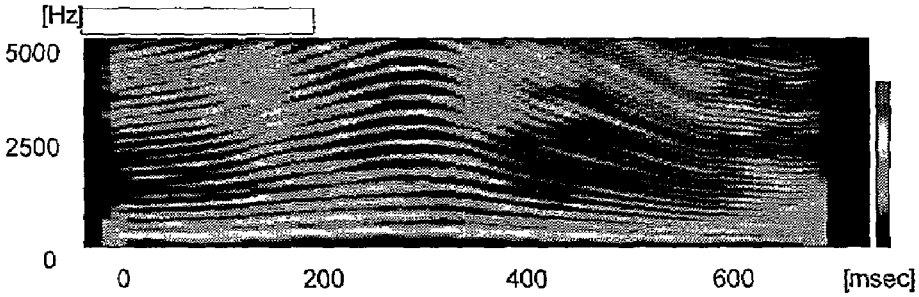
FIGS. 21A–21C show diagrams of spectra illustrating another result of sound signal separation by the sound separation apparatus according to the first embodiment.
Figure 21B:
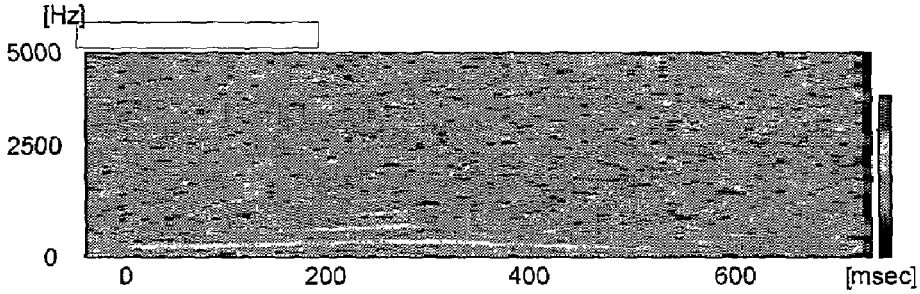
Figure 21C:
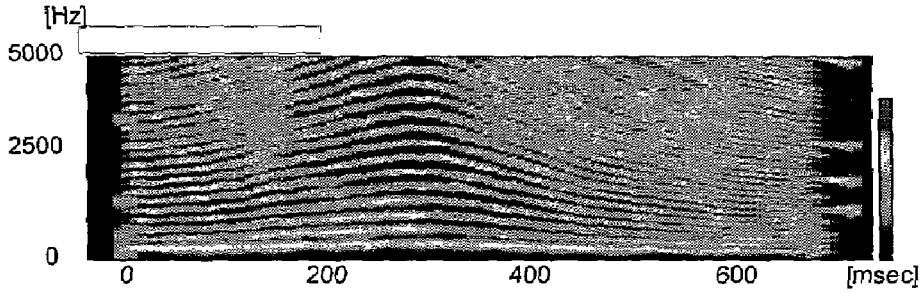

FIGS. 21A–21C illustrate the separation result in the case in which continual noises are intermixed with a target signal. The target signal in FIG. 21A is a part of "IYOIYO" spoken by a female. The signal in which white noises of 20 dB of S/N ratio are intentionally added on the target signal is used as the input signal (shown in FIG. 20B). The output signal (shown in FIG. 20C) is produced by regenerating the waveform based on the feature parameters extracted from the input signal by the first embodiment. It will be apparent that the spectrum pattern of the target signal has been restored accurately.

Figure 22A:
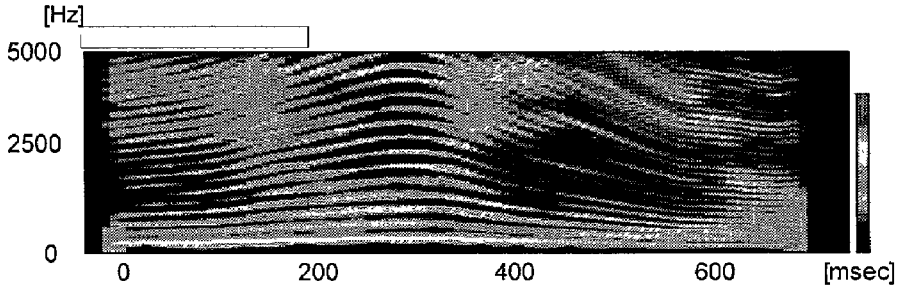
FIGS. 22A–22C show diagrams of spectra illustrating the other result of sound signal separation by the sound separation apparatus according to the first embodiment.
Figure 22B:
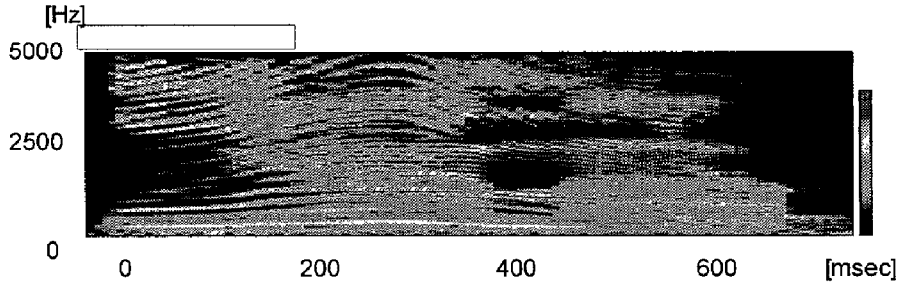
Figure 22C:
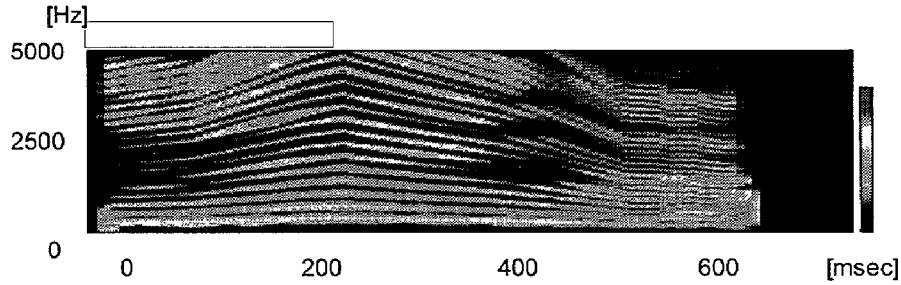

FIGS. 22A–22C illustrate the separation result in the case in which another speech signal is intermixed with a target signal. The target signal in FIG. 22A is a part of "IYOIYO" spoken by a female. The signal in which a male speech "UYAMAU" with the 20 dB of S/N ratio is intentionally added on the target signal is used as the input signal (shown in FIG. 22B). The output signal (shown in FIG. 22C) is produced by means of regenerating the waveform based on the feature parameters extracted from the input signal by the first embodiment. Although the spectrum of the output signal in FIG. 22C seems a little bit different from the target signal in FIG. 22A, the target signal could be restored to such degree that there is almost no problem in terms of practical use.

4. Conclusions

With the sound separation apparatus of the invention as noted above, a target signal may be separated from a mixed input signal by extracting and utilizing dynamic feature amount such as time variation rates for the feature parameters of the mixed input signal in which non-periodic noises are intermixed with the target signal. Furthermore, a target signal of which frequency and/or amplitude changes non-periodically may be separated from the mixed input signal by processing both local feature and global feature in parallel without preparing any template.

Furthermore, with the instantaneous encoding apparatus of the invention as noted above, the spectrum of an input signal in quasi-steady state may be calculated more accurately.

Although it has been described in details in terms of specific embodiment, it is not intended to limit the invention to those specific embodiments. Those skilled in the art will appreciate that various modifications can be made without departing from the scope of the invention. For example, the feature parameters used in the embodiment are exemplary and any new parameters and/or relations among the new feature parameters which will be found in researches in the future may be used in the invention. Furthermore, although time variation rates are used to express the variation of the frequency component candidate points, derivative of second order may be used alternatively.

What is claimed is:

1. Apparatus for analyzing an input sound signal, the apparatus comprising:

a unit signal generator for generating one or more unit signals, each of said unit signals having energy at a center frequency, and being represented by parameters including the center frequency and time variation rate of the center frequency;

an error calculator for calculating an error in an amplitude/phase space between the spectrum of said input sound signal and the spectrum of the sum of said one or more unit signals;

means for iteratively altering said parameters of the unit signals and for having said error calculator recalculate the error until the parameters of the unit signals that provide minimum error are determined; and means for outputting as the encoded signals representing said input sound signal said one or more unit signals determined to provide the minimum error.

2. The apparatus as claimed in claim 1, wherein said generator determines the number of unit signals to be generated responsive to the number of local peaks of power spectrum for said input signal.

3. The apparatus as claimed in claim 1, wherein said center frequency corresponds to a local peak of the power spectrum for said input sound signal.

4. The apparatus as claimed in claim 1, wherein said unit signal is represented by the equation:

$$u(t)_i = a(t)_i \cos(2\pi \int f(t)_i dt) \quad (i=1,2, \ldots, k)$$

where $a(t)_i$ represents a time variation function for instantaneous amplitude and $f(t)_i$ a time variation function for instantaneous frequency.

5. A sound separation apparatus for separating a target signal from a mixed input signal, wherein the mixed input signal includes the target signal and one or more sound signals emitted from different sound sources, comprising:

a frequency analyzer for performing a frequency analysis on said mixed input signal to calculate a spectrum and for determining one or more frequency component candidate points at each time;

feature extraction means for extracting feature parameters for said target signal, comprising:

a) a local layer for performing instantaneous encoding based on said spectrum to determine local feature parameters including frequencies, amplitudes and time variations thereof of the center frequencies of said frequency component candidate points;

b) a harmonic calculation layer for grouping the frequency component candidate points having a same harmonic structure that is determined by the local feature parameters including the frequency and its time variation rate of the frequency component candidate points, and then calculating a fundamental frequency of the harmonic structure, variations of the fundamental frequency, harmonics contained in the harmonic structure, and variations of the harmonics; and c) a pitch continuity calculation layer for calculating a continuity of signal using the fundamental frequency and the variation of the fundamental frequency calculated by said harmonic calculation layer; and a signal regenerator for regenerating a waveform of the target signal based on said feature parameters extracted by said feature extraction means.

6. The sound separation apparatus as claimed in claim 5, wherein said local layer and global layers mutually supply the feature parameters analyzed in each layer to update the feature parameters in each layer based on said supplied feature parameters.

7. The sound separation apparatus as claimed in claim 6, wherein said local layer is an instantaneous encoding layer for calculating frequencies, variations of said frequencies, amplitudes, and variations of said amplitudes at said frequency component candidate points.

8. The sound separation apparatus as claimed in claim 6, wherein said global layer further comprises a sound source direction prediction layer for predicting directions of sound sources for said mixed input signal.

9. The sound separation apparatus as claimed in claim 8, said global layer comprising:

a harmonic calculation layer for grouping frequency component candidate points having same harmonic structure based on said frequencies and the variations of frequency of said frequency component candidate points as well as the sound source directions predicted by the sound source direction prediction layer, and calculating a fundamental frequency of said harmonic structure, harmonics contained in said harmonic structure, and variation of the fundamental frequency and the harmonics; and a pitch continuity calculation layer for calculating a continuity of signals using said fundamental frequency and said variation of the fundamental frequency at points of time.

10. The sound separation apparatus as claimed in claim 6, wherein each of said layers is logically composed of one or more computing elements, each computing elements being capable of calculating feature parameters, each computing elements mutually exchanging said calculated feature parameters with other elements included in upper and lower adjacent layers of one layer.

11. The sound separation apparatus as claimed in claim 10, said computing element executing steps comprising:

calculating a first consistency function indicating a degree of consistency between the feature parameters supplied from the computing element included in the upper adjacent layer and said calculated feature parameters, calculating a second consistency function indicating a degree of consistency between the feature parameters supplied from the computing element included in the lower adjacent layer and said calculated feature parameters, updating said feature parameters to maximize a validity indicator that is represented by a product of said first consistency function and said second consistency function.

12. The sound separation apparatus as claimed in claim 11, wherein said validity indicators are supplied to computing elements included in said lower adjacent layer.

13. The sound separation apparatus as claimed in claim 12, wherein a threshold value is calculated based on said supplied validity indicator and wherein said calculating element may be eliminated if the value of said validity indicator is less than said threshold value.

14. The sound separation apparatus as claimed in claim 12, wherein if the value of said validity indicator exceeds a given value, new computing elements are created in said lower layer.

15. The sound separation apparatus as claimed in claim 5, wherein time variation rates are used as said variations.

16. An instantaneous encoding program recorded on a computer-readable medium and configured to execute the steps of:

performing a frequency analysis on an input signal to determine a spectrum;

generating one or more unit signals, each of said unit signals having energy at a center frequency, and being represented by parameters including the center frequency, time variation rate of the center frequency, amplitude of the center frequency and time variation rate of the amplitude;

calculating an error in amplitude/phase space between the spectrum of said input signal and the spectrum of the sum of said one or more unit signals;

iteratively altering said said parameters of the unit signals for iterative calculation of said error until the unit signals that provide minimum error are determined; and outputting as the encoded signals representing said input signal said one or more unit signals determined to provide the minimum error.

17. The instantaneous encoding program as claimed in claim 16, wherein said generating step includes determining the number of unit signals to be generated responsive to the number of local peaks of power spectrum for said input signal.

18. The instantaneous encoding program as claimed in claim 16, wherein a frequency is selected from local peaks of power spectrum for said input signal.

19. The instantaneous encoding program as claimed in claim 16, wherein said parameters are modeled by a function.

20. A sound separation program recorded on a computer-readable medium and configured for separating a target sound signal from a mixed input sound signal, wherein the mixed input signal includes the target sound signal and one or more sound signals emitted from different sound sources, the program being configured to execute the steps of:

performing a frequency analysis on said mixed input sound signal to calculate a spectrum and determine one or more frequency component candidate points at each time;

extracting feature parameters related to said target sound signal including:

a) determining at a local layer local feature parameters based on said spectrum at said frequency component candidate points, said local feature parameters including one or more center frequencies, time variation rate of the center frequencies to analyze local feature parameters;

b) a harmonic calculation layer for grouping the unit signals having a same harmonic structure that is determined by the local feature parameters including the time variation rate of the center frequencies, and then calculating a fundamental frequency of the harmonic structure, variations of the fundamental frequency, harmonics contained in the harmonic structure, and variations of the harmonics; and c) calculating at a pitch continuity calculation layer a continuity of signal based on said fundamental frequency and said variation of the fundamental frequency at each point in time; and regenerating a waveform of the target sound signal based on said feature parameters extracted by the extracting step.

21. The sound separation program as claimed in claim 20, wherein said local layer and global layers mutually supply the feature parameters analyzed in each layer to update the feature parameters in each layer based on said supplied feature parameters.

22. The sound separation program as claimed in claim 21, wherein said local layer is an instantaneous encoding layer for calculating frequencies, variations of said frequencies, amplitudes, and variations of said amplitudes for said frequency component candidate points.

23. The sound separation program as claimed in claim 21, wherein said global layer further comprises a sound source direction prediction layer for predicting directions of sound sources for said mixed input sound signal.

24. The sound separation program as claimed in claim 23, said global layer comprising:

a harmonic calculation layer for grouping frequency component candidate points having same harmonic structure based on said frequencies and the variations of frequency of said frequency component candidate points as well as the sound source directions predicted by the sound source direction prediction layer, and calculating a fundamental frequency of said harmonic structure, harmonics contained in said harmonic structure, and variation of the fundamental frequency and the harmonics; and a pitch continuity calculation layer for calculating a continuity of signals using said fundamental frequency and said variation of the fundamental frequency at points of time.

25. A sound separation program as claimed in claim 21, wherein each of said layers are logically composed of one or more computing elements, each computing element being capable of calculating feature parameters, each computing element mutually exchanging said calculated feature parameters with other computing elements included in upper and lower adjacent layers of one layer.

26. The sound separation program as claimed in claim 25, said computing element executing steps comprising:

calculating a first consistency function indicating a degree of consistency between the feature parameters supplied from the computing element included in the upper adjacent layer and said calculated feature parameters, calculating a second consistency function indicating a degree of consistency between the feature parameters supplied from the computing element included in the lower adjacent layer and said calculated feature parameters, updating said feature parameters to maximize a validity indicator that is represented by a product of said first consistency function and said second consistency function.

27. The sound separation program as claimed in claim 26, wherein said validity indicators are supplied to computing elements included in said lower adjacent layer.

28. The sound separation program as claimed in claim 27, wherein a threshold value is calculated based on said supplied validity indicator and wherein said calculating element may be eliminated if the value of said validity indicator is less than said threshold value.

29. The sound separation program as claimed in claim 27, wherein if the value of said validity indicator exceeds a given value, new computing elements are created in said lower layer.

30. The sound separation program as claimed in claim 20, wherein time variation rates are used as said variations.

* * * * *